United States Patent [19]

Yamamori

[11] Patent Number: 5,009,147

[45] Date of Patent: Apr. 23, 1991

[54] SOUND GENERATING UNIT SYSTEM FOR ELECTRONIC INSTRUMENTS

[75] Inventor: Takenori Yamamori, Hamamatsu, Japan

[73] Assignee: Roland Corporation, Osaka, Japan

[21] Appl. No.: 356,308

[22] Filed: May 23, 1989

[30] Foreign Application Priority Data

May 25, 1988 [JP] Japan ..... 63-127486
Jun. 23, 1988 [JP] Japan ..... 63-153652

[51] Int. Cl.[5] ..... G10H 1/057; G10H 1/42; G10H 1/46

[52] U.S. Cl. ..... 84/618; 84/627; 84/633; 84/635

[58] Field of Search ..... 84/609-614, 84/622-627, 633-638, 618, DIG. 2, DIG. 12

[56] References Cited

U.S. PATENT DOCUMENTS 3,844,379 10/1974 Tomisawa et al. .
4,706,538 11/1987 Yoshida ..... 84/DIG. 2
4,711,148 12/1987 Takeda et al. .
4,882,964 11/1989 Okamoto et al. ..... 84/611

FOREIGN PATENT DOCUMENTS 0030034 6/1981 European Pat. Off. .
2449935 9/1980 France .

*Primary Examiner*—Stanley J. Witkowski
*Attorney, Agent, or Firm*—Beveridge, DeGrandi & Weilacher

[57] ABSTRACT

Disclosed is a system of sound generating units for generating musical sounds according to a sequential order in electronic musical instruments such as instruments comprising a keyboard, an electronic drum apparatus, a rhythm machine or an automatic performing or accompanying apparatus. Consecutive note-on messages are processed to identify musical tones generated by the same notes, whereafter the same tones are superposed. This enables a well balanced generation of sounds between the sound generating units as the units generate sounds in a circulative sequence in response to performance controlling messages that are received by the units, according to a preferential order. The system of the present invention further provides a good reproduction of volume changes in composite musical tones, which changes are due to attenuation caused by a new note-on message that alters the volume of a musical tone as such tone is generated in response to a previous note-on message.

19 Claims, 15 Drawing Sheets

| RECEIVED DATA (RCVD) | 1st BYTE (STAT) | 2nd BYTE (DAT1) | 3rd BYTE (DAT 2) |
|---|---|---|---|
| KEY-PRESS DATA | 1001nnnn | 0kkkkkkk | 0vvvvvvv |
| KEY-OFF DATA | 1001nnnn | 0kkkkkkk | 00000000 |
| | 1000nnnn | 0kkkkkkk | 0vvvvvvv |
| Damper ON | 1011nnnn | 01000000 | 01111111 |
| Damper OFF | 1011nnnn | 01000000 | 00000000 |

nnnn: SIGNAL RECEIVING CHANNEL NO.
kkkkkkk: NOTE NO.
vvvvvvv: VELOCITY

SOUND GENERATING UNIT SYSTEM FOR ELECTRONIC INSTRUMENTS

BACKGROUND OF THE INVENTION

1. Field of the Invention

The invention relates to a system of electronic musical instruments such as an electronic keyboard instrument, an electronic drum apparatus, a rhythm apparatus, an automatically performing apparatus, an automatically accompanying apparatus, or the like. In particular, the invention relates to a technology by which sound generating units in such electronic musical instruments are caused in sequence to generate musical tones, as well as to a further technology for processing a succeeding additional "note-on" signal that is input to said electronic musical instruments after the preceding same musical note has been input thereto so that the same musical tones are superposed one on another.

2. Description of Related Art

Each of the musical tone-generating apparatuses that are currently known has only a limited number of, for instance sixteen, tone generators. Accordingly, in such electronic musical instruments of this type, there will occur a shortage of generated musical tones in playing many sounds at the same time while a hold pedal is pressed down. In other words, some tones are not generated, or undesirably decay or die away quickly in such a case.

The so-called musical instrument digital interface (MIDI) is widely employed in electronic musical instruments so as to transmit tone-generating control data between unit apparatuses included therein. The MIDI has therefore given rise to a new system of electronic musical instruments such that a tone data-generating apparatus is coupled with a plurality of tone-generating apparatuses by means of the MIDI. In this case, some additional tone-generating apparatuses can be added to the existing ones and connected by the MIDI to the tone data-generating apparatus in order that a possible insufficiency in the number of sound sources may be complemented.

Also proposed already is another system of electronic musical instruments in which one keyboard apparatus is connected with each of two musical tone-generating apparatuses (A) and (B) by means of the MIDI wherein note signals carrying odd code numbers are selectively received by the apparatus (A) whereas the other note signals carrying even code numbers are selectively received by the other apparatus (B). According to this system, a series of tone control data are divided into two groups that are respectively supplied to the tone-generating apparatuses (A) and (B), resulting in an increase of the numbers of musical tones simultaneously generated at a time because there is no chance that the keyboard apparatus is operated only for the musical notes carrying the odd numbers or only for those carrying the even numbers. These note signals from the tone-generating apparatuses (A) and (B) are processed by a common amplifier and are output through a common loud-speaker.

On the other hand, in another known system, if a succeeding second note-on signal for a musical note is to be fed to a tone-generating apparatus to which a preceding first note-on signal has been fed as the same musical tone in order to superpose these same musical tones one upon another, then the second signal is assigned to a musical tone-generating channel different from the tone-generating channel to which the first tone was assigned.

Subsequent to said processing in the known system, a sound of the tone which is being produced in response to the preceding note-on signal is damped quickly upon initiation of the tone generation corresponding to the assignment of the second note-on signal to the tone-generating channel.

SUMMARY OF THE INVENTION

In the known system, however, the notes corresponding to the even-numbered note-on signals take place more frequently or less frequently than the notes corresponding to the odd-numbered note-on signals. Thus, one of the tone-generating apparatuses is likely to be activated more times to produce more musical tones than the others do whereby a balance of activation times between the tone-generating apparatuses is hardly ensured.

In musical instruments of the kind in which each note decays or dies away, each tone is generated by striking a tone-generating body (string, diaphragm or the like). Accordingly, when the tone-generating body which has generated a musical tone generates the same musical tone again in a superposed manner, the previously generated tone is weakened when the tone-generating body is struck again and a newly generated tone is added.

Taking the piano for an example, where successive strikes are made so as to superpose the same musical tone, a string which is still vibrating following the previous key-depression, is struck again by a hammer, the vibration caused by the previous key-depression is partially damped by contact with the hammer, and energy generated by the new key-depression is added.

However, in such a case as referred to in the Description of Related Art where the subsequent notes of the same tone are simply and individually assigned to the different tone-generating channels, the generated volume of said tone is undesirably increased, thereby causing a kind of problem.

This problem may be eliminated by the system in which, as also referred to above, the tone generated by the previous note-on signal is damped upon initiation of the generation of a tone caused by the subsequent note-on signal. However, there arises another problem in that the tone is quickly weakened to an undesirable degree when the second musical tone taking place based on the subsequent note-on signal superposed on the first musical tone taking place based on the previous note-on signal has a smaller generated volume (amplitude) than the earlier first tone.

It is therefore an object of the invention to provide a system of electronic musical instruments including tone-generating apparatuses, in which system all of the said apparatuses are activated in an averaged manner to generate musical tones, and utilized in such an effective manner that simultaneously generated tones can be increased to a maximum which is equal to a total number of tone generators included in said apparatuses.

It is another object of the invention to provide such a system of electronic musical instruments that a generated volume of musical tones does not increase unwantedly undesirably nor are the tones weakened suddenly whereby the two successive musical tones thus generated are slurred together naturally without giving a sense of incongruity.

It is still another object of the invention to provide a system of sound generating units for electronic musical instruments in which simulation is carried out with high fidelity when the same musical tones are generated to be superposed one upon another.

In order to achieve the objects mentioned above, the system in accordance with the invention has characteristic features as shown in FIG. 1A and comprises:

a plurality of sound generating units (2) each adapted to receive performance controlling messages from performance message generating apparatuses (1);

wherein each of said sound generating units (2) comprises:

recording means (3) for recording preferential orders that determine a sequential order by which said sound generating (2) receives the performance controlling messages;

selecting means (4) for selecting the performance controlling messages to receive the same in accordance with the preferential orders recorded in the recording means (3); and tone-generating means (5) for generating musical tones based on the performance controlling messages that have been received by the selecting means (4).

Thus, the sound generating units are caused to generate sounds in accordance with the selectively received performance controlling messages which are given to said units according to the preferential orders arranged in circulative sequence. Therefore, a good balance is provided between the sound generating units because their assignments to generate sounds are nearly equal without any remarkable unevenness in the number of times they generate sounds.

Also in order to achieve the objects mentioned above, the system of sound generating units for electronic musical instruments in accordance with the invention has characteristic features as shown in FIG. 1B and comprising:

a plurality of sound generating units (2') each adapted to receive performance controlling messages from performance message generating apparatuses (1');

wherein each of the sound generating units (2') comprises:

recording means (3') for recording preferential orders that determine a sequential order by which said sound generating unit (2') receives the performance controlling messages;

selecting means (4') for selecting the performance controlling messages to receive the same in accordance with the preferential orders recorded in the recording means (3');

tone-generating means (5') having musical tone-generating channels and causing the same to generate musical tones based on the performance controlling messages that have been received by the selecting means (4');

first detecting means (6') for detecting whether or not a second musical tone to be generated which tone is assigned by a new note-on message to musical tone-generating channels in the tone-generating means, and a first or previous musical tone which has been already assigned by a previous note-on message to the musical tone-generating channels, are the same musical tone;

second detecting means (7') for detecting a volume of the first musical tone, or a value equivalent to that generated volume which was assigned to the tone-generating channels in the tone-generating means (5') and is being generated based on the previous note-on message at an instance when the new note-on message is received to generate the same tone;

calculating means (8') for calculating a residual generated volume or a value equivalent thereto, based on the generated volume or a value equivalent thereto which is detected by the second detecting means (7'); and changing means (9'), where the first detecting means (6') detects that the second musical tone based on the new note-on message is the same as the first musical tone already assigned by the previous note-on generating means (5'), for changing the generated volume of said already assigned first musical tone, or the value equivalent thereto, assigned by said previous message to said channels in the tone-generating channels (5') to the residual generated volume or the value equivalent thereto calculated by the calculating means (8').

Thus, the sound generating units are equalized as to their sound generating times or frequencies, and further, the generated volume of the tone based on the previous note-on message is changed to the residual generated volume, or said value equivalent thereto, so that a change in volume is reproduced to realize an attenuation based on the tone which corresponds to the new note-on message.

The second detecting means (7') may be a detecting means for detecting the generated volume or the value equivalent thereto, based on a constituent tone mainly constituting a continuing portion of a musical tone to be generated, to give a feeling of volume.

The changing means (9') may be a changing means for altering an envelope of the first or previous musical tone, which has been already assigned by the previous note-on message to the tone-generating channels in its tone-generating means (5'), to thereby change the generated volume of the first musical tone or the value equivalent thereto into the residual generated volume or the value equivalent thereto.

The second first detecting means (6') may be such means that either simulates an envelope waveform of the musical tone so as to detect the aforementioned generated volume or the value equivalent thereto, or detects said generated volume or the equivalent thereto of the musical tone on the basis of an envelope level.

The systems according to the invention described hereinbefore may further comprise shifting means (6) or (10') for shifting in a circulative manner the preferential orders that are stored by the recording means based on the performance controlling messages, on the basis of an initial information regarding initial preferential orders and the total number of sound generating units.

Said systems may further comprise recovering means (11') for changing notes assigned to the tone-generating channels from their note-off states to their note-on states when the first detecting means detects that a note which is specified by a previous note-on message and which has already been assigned to the tone-generating channels is the same musical tone as that specified by a new note-on message.

The aforementioned performance message generating apparatus may be a mother keyboard or a sequencer.

The system of electronic musical instruments may be those provided with a keyboard, or a system of electronic drum apparatuses, a system of rhythm machines, a system of automatically performing apparatuses, or a system of automatically accompanying apparatuses.

Other objects of the present invention will become apparent from the detailed description given hereinafter. However, it should be understood that the detailed description and specific examples, while indicating preferred embodiments of the invention, are given by the way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIGS. 2 through 10 illustrate a first embodiment of the invention, in which:

FIG. 2 shows in outline the system in the first embodiment;

FIG. 3 shows also in outline a sound generating unit constituting the system;

FIG. 4 illustrates binary coded received data that are supplied from a signal-detecting circuit;

FIGS. 5, 8 and 9 respectively show flow-charts of a main routine, a damper processing subroutine, and a preferential order-shifting subroutine which constitute a program executed by a microcomputer in the first embodiment;

FIG. 6 is a touch-response data-attack level conversion graph relating to the first embodiment;

FIG. 7 is an envelope waveform graph of a musical tone composed of ADSR (attack, decay, sustain and release) portions and generated in the first embodiment;

FIG. 10 illustrates an example of the first embodiment wherein three sound generating units are employed in such a state that preferential orders are alternatively changed in sequence at each time key-depression data is received from a keyboard apparatus; and FIGS. 11 through 23 illustrate a second embodiment of the invention, in which:

FIGS. 11; 13; and 14A & 14B respectively show flowcharts of a main routine, a consecutive strike-detecting subroutine, and a consecutive strike-processing subroutine which constitute a program executed by a microcomputer in the second embodiment;

FIG. 12 is a touch-response data-attack level conversion graph relating to the second embodiment;

FIG. 15 shows envelope waveforms of musical tones that are generated by striking one and the same key two times while a damper pedal is pressed down and by releasing the damper pedal thereafter with said key held at its struck state;

FIG. 16 shows envelope waveforms of first and a second musical tones that are generated by newly striking one key before the first musical tone generated by a previous striking of that key has died away after release of that key;

FIGS. 17 and 18 show envelope waveforms of sounds generated according to musical tones that are processed according to the flow-charts shown in FIGS. 11; 13; and 14A & 14B;

FIGS. 19 and 20 show further envelope waveforms relating to the second embodiment;

FIG. 21 illustrates still further envelope waveforms of a first constituent tone A, a second constituent tone B1 and another second constituent tone B2, these constituent tones relating to a modified example 1 of the second embodiment; and FIGS. 22 and 23 respectively illustrate, relating to a modified example 3 of the second embodiment, envelope waveforms of first and a second constituent tones A' and B' and a touch-response data-attack level conversion graph corresponding to such a graph as shown in FIG. 12.

DETAILED DESCRIPTION OF THE PREFERRED EMBODIMENTS

Systems of electronic musical instruments in the preferred embodiments of the invention will now be explained with reference to the accompanying drawings.

FIRST EMBODIMENT

Figures 2, 4:
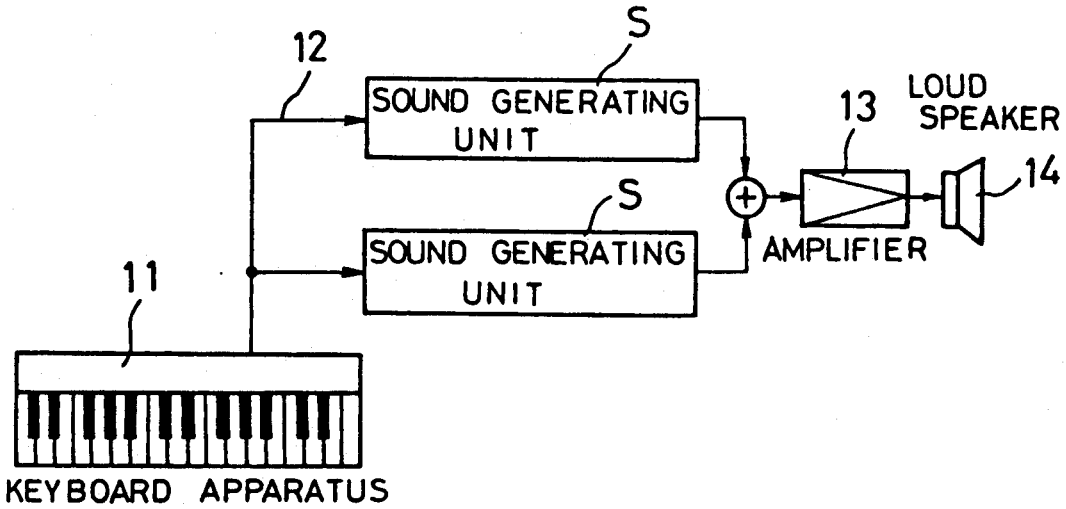
Figure 3:
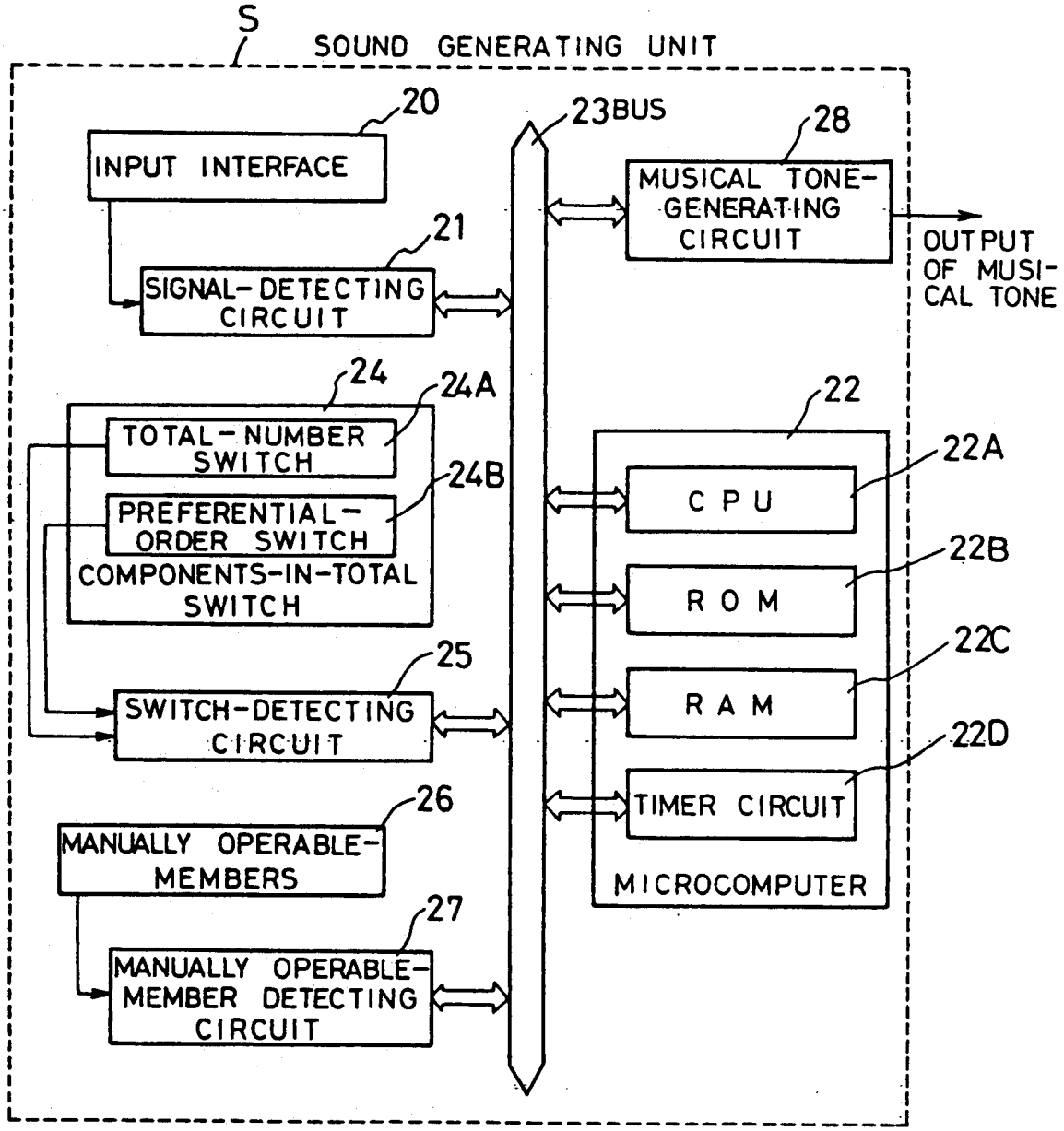

FIG. 2 illustrates an outline of a system of musical instruments comprising a keyboard apparatus 11 as an example of performance message generating apparatuses, which keyboard apparatus 11 is connected by an MIDI 12 to respective sound generating units S. Musical tone signals generated in the sound generating units S are summed up and then fed through an amplifier 13 to a loud speaker 14 to thereby produce audible sounds. FIG. 3 shows in outline, one of the sound generating units S. In FIG. 3, an input interface 20 qualified as an MIDI receives data as performance controlling messages in the invention, and delivers the same to a signal-detecting circuit 21 to be detected thereby. A plurality of data as outputs from the signal-detecting circuit 21 are sorted to select some data necessary for the sound generating apparatuses S. FIG. 4 illustrates that each of the received data RCVD that are received by the signal-detecting circuit 21 comprises three bytes consisting of a first byte STAT, a second byte DAT1 and a third byte DAT2. These data are stored in a buffer included in the signal-detecting circuit 21. The thus stored data are charged to a microcomputer 22 through a bus 23 together with the total number of the received data BSTN under control by the microcomputer.

The data that were referred to above as the necessary data for the sound generating apparatuses S include, as shown in FIG. 4, key-press data, key-off data, as well as damper data that relate to a damper which is pressed down to inhibit damper processing. This damper processing would otherwise accelerate the damping of sounds, therefore the damper data are needed to prolong a period of decaying time. The buffer may further store, if necessary, after-touch data, program-changing data, control-changing data, mode-message data, and/or system-exclusive data if they are selected. As seen in FIG. 4, the key-press and the key-off data as well as the damper-on and the damper-off data are binary coded. Each of the first bytes STAT of those data comprises four leading bits and four trailing bits "nnnn", "n" indicating signal-receiving channels. Seven trailing digits "kkkkkkk" in the second bytes DAT1 indicate ordinal numbers corresponding to key codes whereas the other seven trailing digits "vvvvvvv" in the third bytes DAT2 indicate velocities. (These components of data will hereinafter be simply called "n", "k" and "v" if decimals are adopted to indicate them, and "n" may vary from 0 (zero) to 15 while "k" and "v" fall within a range of 0 (zero) to 127.) It is to be noted here that the signal-detecting circuit 21 in the sound generating units S is, for the sake of convenience, regarded in this description to be capable of receiving signals through the signal-receiving channels 0 to 7 only, and incapable of receiving them through channels 8 to 15. The signal-receiving channels 0 to 7 are assigned to eight timbres or musical tones such as those of the piano, the harpsichord and so on.

An operator of this system is instructed to make previous settings of a total-number switch TOTLSW 24A and a preferential-order switch PRIOSW 24B, these switches constituting a components-in-total switch 24. The preset states of the switches TOTLSW 24A and PRIOSW 24B are detected by a switch-detecting circuit 25 so as to be charged to the microcomputer 22 as incorporated-components data TOTL and as initial data PRIO of the preferential orders. The operator can employ a total number of the sound generating units S as such a data TOTL that is to be set on the switch TOTLSW 24A. On the other hand, he can make use of the switch PRIOSW 24B to assign numerals from "1" to a higher ordinal to the respective sound generating units S, as the initial data of the preferential orders. The higher ordinal corresponds to the incorporated-components data TOTL, and assigning of such numerals has to be carried out sequentially not to involve any overlapping or doubling of the numerals between any two or more such units S.

The microcomputer 22 is further charged with manually operable member data MNPh through a manually operable member detecting circuit 27, the data MNPh representing operated states of a group of manually operable members 26. These members 26 serve the purpose of switching over or adjusting the timbres and the generated volume of each musical tone. It is to be noted that all of the aforementioned data, namely the incorporated-components data TOTL, the initial data PRIO of preferential orders, and the manually operable member data MNPh, are those which indicate the states of related parts or components at the moment when they are charged to the microcomputer 22 for control of the system thereby.

The microcomputer 22 itself comprises a central processing unit (CPU) 22A executing the predetermined programs, a read only memory (ROM) 22B storing the programs, a random access memory (RAM) 22C used as a working memory required for executing the programs and also as registers allotted to the received data RCVD, the incorporated-components data TOTL, the initial data PRIO of preferential orders, and the manually operable member data MNPh. In addition, the microcomputer further comprises a timer circuit 22D consisting of a group of timers or clocks that determines the times or moments during execution of the programs. A tone-generating circuit 28 having sixteen (16) tone-generating channels in the first embodiment is activated and controlled by executing the aforementioned programs by means of the received data RCVD, incorporated-components data TOTL, the initial data PRIO of preferential orders, and the manually operable member data MNPh. Desirable musical tone signals are produced respectively by the thus determined and assigned tone-generating channels.

Figure 5:
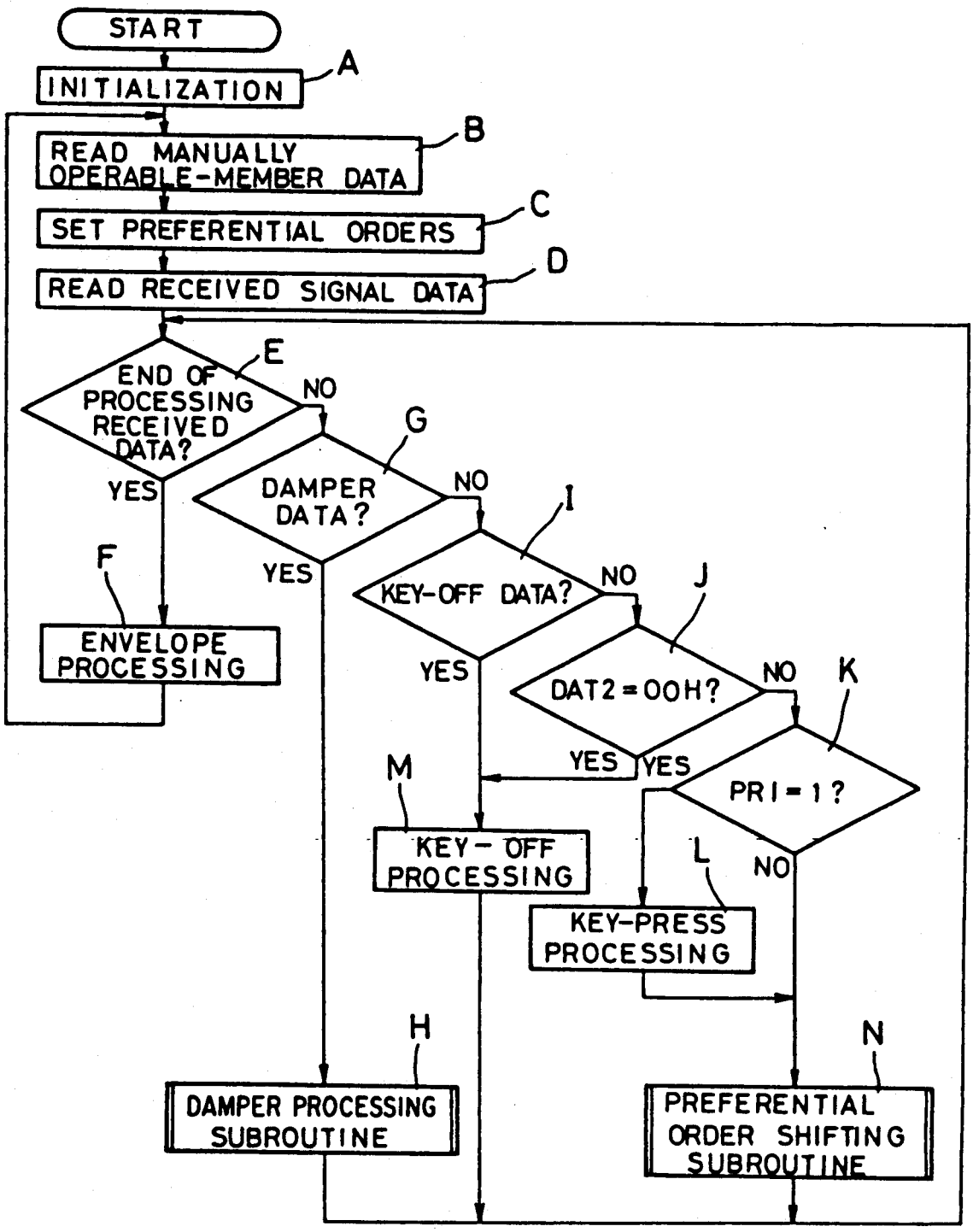

Basic functions of the sound generating units S as constructed in a manner described hereinbefore will now be explained in detail on a step-by-step basis referring to FIG. 5 in which given is a flow-chart of a main program of the microcomputer.

A. At first, power is turned on in order to start up execution of the predetermined programs, and the contents of the RAM 22C of the microcomputer 22 are cleared up for use as the registers or the like in the execution. An initialization command is given to the signal-detecting circuit 21, the switch-detecting circuit 25 and the manually operable member circuit 27.

B. The manually operable member data MNPh is read from the manually operable member circuit 27. By means of the data MNPh, desired parameters corresponding to the aforementioned eight timbres are read from a predetermined table stored in the ROM 22B. The parameters are then converted into parameter groups GTEm(0) to GTEm(7) that are written into predetermined registers GTEm(0)R to GTEm(7)R, respectively.

The parameter groups may be named GTEm(n) inclusively to indicate each parameter group that is allocated to the timbre which corresponds to the signal-receiving channel carrying the number "n". As described above, the received data RCVD each include the number "n" of a signal-receiving channel. Accordingly, a musical tone for generating an audible sound is generated by using the parameter group GTEm(n) corresponding to the signal-receiving channel "n". Thus, each of the sound generating units S can generate various timbres under control by the ordinal number "n" carried by said signal-receiving channels.

C. The incorporated-components data TOTL and the initial data PRIO of preferential orders are read from the switch-detecting circuit 25. These newly read data are then compared respectively with the previous incorporated-components data TOTL and the previous initial data PRIO that are on the register at that time when the read step is performed. The newly read data are written into registers TOTLR and PRIOR, if they differ from the previous ones. There are also provided other registers PRIR to which the initial data PRIO of preferential orders are set as preferential orders. The registers TOTLR, PRIOR and PRIR are, as described above, already at their cleared up states at the start of execution of the programs because the RAM 22C was cleared when power was turned on. Thus, the preferential order data PRI that are written into the other registers PRIR are automatically set to their initialized states to give the initial data PRIO of preferential orders.

D. The received data RCVD are read from the signal-detecting circuit 21, each of the data comprising the first byte STAT, the second byte DAT1 and the third byte DAT2. These data are written into respective corresponding areas of a register RCVDR, according to a sequence of time lapses taking place in such areas. Further, a total number BSTN of the received data RCVD is also read to be written into a register STNR as a total number STN of newly charged data that are to be processed.

E. Decision is made as to whether or not the processing of received data RCVD has finished, based on whether the total number STN of data to be processed is or is not "0" (zero) in the register STNR storing said data. If the number STN of the data to be processed is "1" or more indicating a state that the processing thereof has not yet been completed, then the process goes to Step G.

F. If, on the contrary, the number of STN of the data to be processed is judged to be "0" in Step E, then the processing of the received data RCVD is regarded to have finished. Accordingly, the process advances forward to sequentially perform the following envelope processings within respective envelope waveform-producing channels that correspond to the tone-generating channels, respectively.

Figure 6:
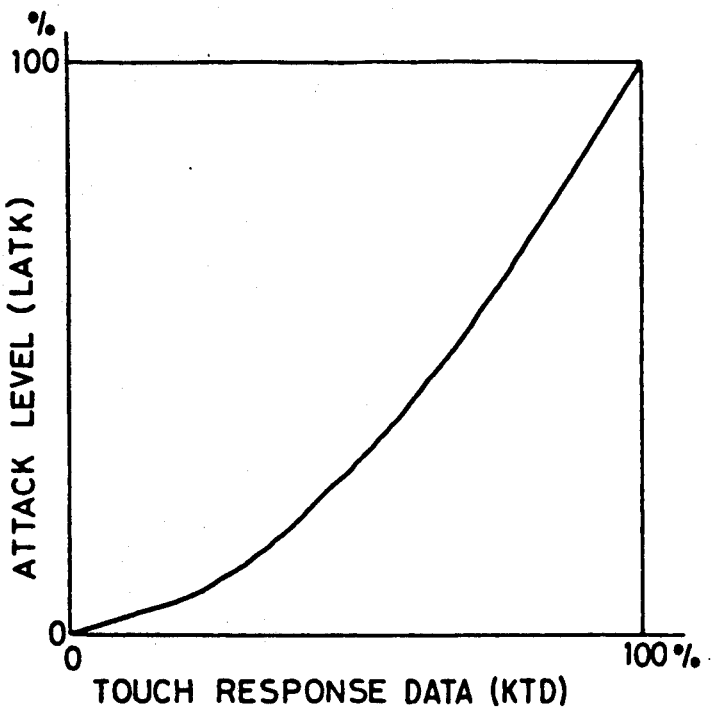

(I) A predetermined table of envelope waveforms stored in the ROM 22B is read therefrom. Further, reference is made to the group of parameters GTEm(n) relating to musical tone generation and written in respective registers GTEm(n)R that correspond to respective signal receiving channels carrying the number "n". These numbers, in turn, are written in registers nR in accordance with the respective tone-generating channels. Furthermore, reference is also made to key codes KYC and touch response data KTD that are written in registers KYCR and KTDR as described later. Based on all of the foregoing parameters in this paragraph (I), rates RT and break instant levels LBP are calculated and produced. Each rate RT shows a value of change in envelope per predetermined unit time (and includes a plus or minus sign according to an increase (swell) or decay of an envelope). Each of the break instant levels LBP shows on the other hand the envelope level at the instant of change in the accumulated rate RT, in other words, at the instant when the slope of envelope changes. Thus, the rates RT and the break instant levels LBP constitute a group of rates RTj and a group of break instant levels LBPj, respectively. Still further, reference is made to a table that is previously stored in the ROM 22B and corresponds to a graph as shown in FIG. 6 which represents a convertible relation between the touch response data KTD and attack levels LATK, in order to produce the attack levels LATK. (The group of rates RTj, the group of break instant levels LBPj, and the attack levels LATK will hereinafter be called envelope parameters, inclusively.)

(II) Envelope levels LEV, that is, envelope waveforms, are calculated based on the predetermined group of rates RTj and the predetermined group of break instant levels LBPj which in turn are calculated as described above. (Calculation of LEV is carried out as follows. From the troup of break instant levels LBPj written in a register LBPjR, selected are those levels which correspond to envelope steps "j" written in a register jR, in order to be written into a register LBPR. Similarly, selected from the group of rates RTj written in a register RTjR are those rates which correspond to the envelope steps "j" written in the register jR, the selected rates being written into a register RTR. Next, the rates RT in the register RTR are added in an accumulative manner to the envelope levels LEV. A numeral "1" is added to the envelope steps "j" when the thus accumulated value becomes equal to the break instant levels LBP written in the register LBPR The value "j" added to "1" is then written into the register jR as a new envelope step "j". These steps are repeated to calculate the values LEV.)

Figure 7:
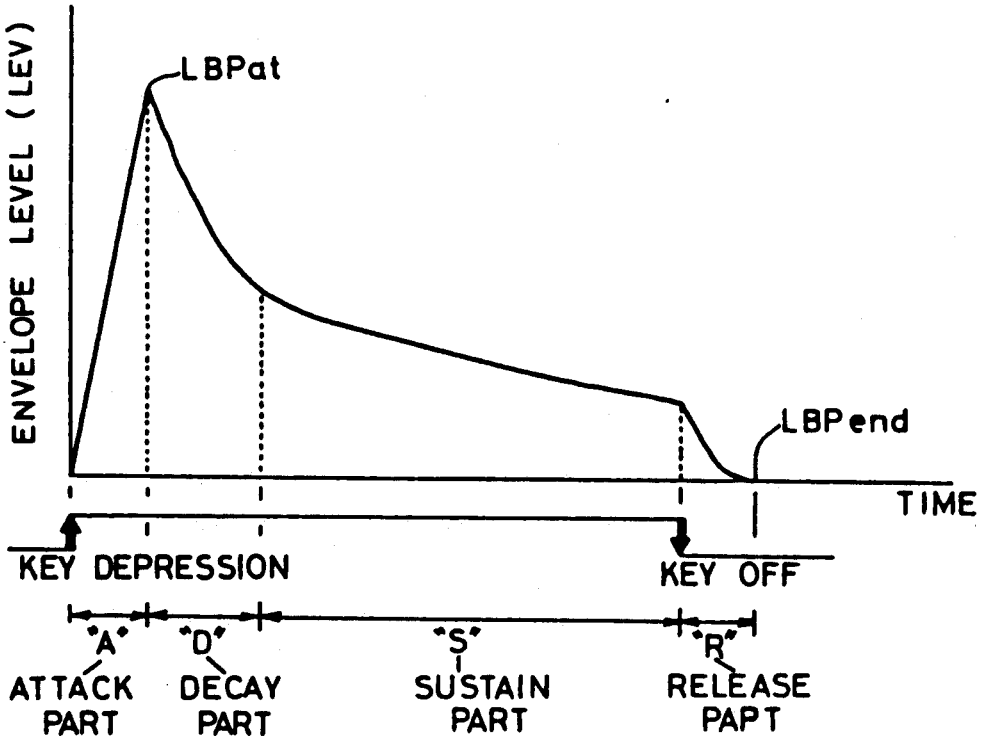

(III) The envelope waveforms are produced in the manner as described in the preceding paragraph (II). A decision is made on such envelope waveforms as to whether or not an attack part "A" in the so-called "ADSR" representation as shown in FIG. 7 has finished. This decision is done by judging whether the envelope level LEV has become a break instant level LBPat (this level being identical with the attack level LATK). If an answer is "Yes", then "0" (zero) is set to an attack-part end flag EV-AT. Similarly, "0" is set to an envelope completion flag EV-END if a release part "R" is judged to have been completed, based on a decision made on whether the envelope level LEV has or has not become equal to a break instant level LBPend which corresponds to completion of the release part "R". The value "0" on the envelope completion flag EV-END releases the corresponding tone-generating channel.

(Every envelope waveform-producing channel is provided with all of the foregoing data each determined as described above and including the group of rates RTj, the group of break instant levels LBPj, the attack level LATK; the rates RT, the break instant levels LBP, the envelope levels LEV and the envelope steps "j" to be calculated; as well as the flags EV-AT and EV-END. Accordingly, registers RTjR, LBPjR, RTR, LBPR, LEVR, jR, EV-ATR and EV-ENDR are also owned by each of the envelope wave-form-producing channels in such a manner that they constitute one group and are treated with as such one group.)

If a key-off envelope in-processing flag RKOF is set at "1" to be written into a register RKOFR thus urging a key-off processing (i.e., Step M described later) to start, and if at the same time "0"(zero) appears on a damper state flag FCDS(n) thereby indicating a damper pedal is not pressed down wherein the flag FCDS(n) is a flag written in a register FCDS(n)R corresponding to the ordinal number "n" of signal-receiving channels in the tone-generating channels, then the attack-part end flag EV-AT written in the corresponding register EV-ATR will indicate with signal "0" the completion of attack part "A", and thereafter the key-off envelope in-processing flag RKOF is reset at "0" to thereby change the envelope waveform into a predetermined key-off envelope. A manner of producing the key-off envelope is similar to that described in the former paragraphs.

The process returns to Step B after the envelope processing.

G. If the total number STN of data to be processed is judged to be "1" at Step E thereby indicating that the processing of key operations has not yet finished, then "1" is subtracted from the number STN so as to produce a new number to be written into the register STNR. Subsequent to this procedure, the oldest received data RCVD in the register RCVDR is read therefrom (first-in, first-out method) so that a signal-receiving channel number "n" given at four trailing bits of the first byte STAT in the oldest data RCVD is written into a signal-receiving channel buffer BnR. Further, the oldest data is either judged to be, or not to be, damper data depending upon whether or not four leading bits of said first byte STAT has a value of "BH" ("H" denoting that "B" is a hexadecimal) on condition that the second byte DAT1 has a value of "40H". Therefore, if the four leading bits of the first byte STAT do not have the value of "BH", or if the second byte DAT1 does not have the value of "40H", then the oldest received data is judged not to be a damper data and the process advances forward to Step I.

H. If, at the Step G, the four leading bits of the first byte STAT as a whole are judged to have the value of "BH"("H" also denoting hexadecimal), and concurrently the second byte DAT1 is judged to have the value of "40H", then the received data RCVD is judged to be damper data whereby the process comes to this damper processing subroutine of Step H. The details of this subroutine will be described later referring to the flow-chart in FIG. 8. The process returns to Step E after the subroutine has finished.

I. If the received data RCVD is judged at Step G not to be damper data, then the value "k" of the second byte DAT1 of received data RCVD is written into a register BKYCR as a key code "BKYC", and the value "v" of the third byte DAT2 is written into a register BKTDR as touch response data BKTD. Next, decision is made on whether the received data RCVD is or is not a key-off data, based on whether four leading bits as a whole of the first byte STAT in said data RCVD have a value of "8H". If said four bits have the value of "8H" indicating key-off data, then the process goes to Step M.

J. Further, decision is made again on whether the received data RCVD is or is not key-off data, based on whether or not the third byte DAT2 has a value of "00H" in case where the four leading bits of the first byte STAT included in said data RCVD do not have a value of "8H" as a whole. If said third byte DAT2 has the value of "00H" indicating key-off data, then process goes to Step M.

K. In case where the received data RCVD is judged at Step J to be key-press data because the value of the third byte DAT2 is not "00H", decision is made on whether the preferential order data PRI stored in the register PRIR is or is not "1". If the preferential order data PRI is not "1", the process goes to Step N. A purpose of the decision made here at Step K is to prevent generation of the musical tone corresponding to the key-press data unless the preferential order data PRI is "1".

L. If the preferential order data PRI is found to be "1" by the decision at Step K, a key-press processing is executed in the following manner.

(Respective musical tones are assigned to the respective musical tone-generating channels by writing predetermined data into musical tone-allocating channels each corresponding to the former channels, and in particular by writing them into a key state flag KYS, the key code KYC, the touch response data KTD, a pitch data FQY and a group of musical tone or timbre parameters TNp. In detail, numeral "1" which is carried by the key state flag KYS and indicates a key pressed state of key is written into a register KYSR, and a value carried by a register BKYCR is written into the register KYCR as the key code KYC. Further, a value carried by the register BKTDR is written into the register KTDR as the touch response data KTD. Furthermore, written into a register FQYR are the pitch data FQY that are calculated and produced from the group of parameters GTEm(n) that relate to generation of musical tones and are written in registers GTEm(n)R corresponding to the signal-receiving channel number "n" carried by the signal-receiving channel buffer BnR wherein the key codes KYC written in the register KYCR are also utilized in such a calculation. The following processings are performed too, in addition to the foregoing ones: namely, calculation and production of the group of musical tones or timbres TNp based on the group of parameters GTEm(n) relating to generation of musical tones so that the parameters are written into a group of timbre parameter registers TNpR whereby such timbres that correspond to the signal-receiving channel number "n" are assigned to and set at the musical tone-allocating channels; the resetting the key-off envelope in-processing flag RKOF in the corresponding waveform-producing channel to "0" so as to be written into the RKOFR such that the register jR into which the envelope step "j" is written as well as the register LEVR into which the envelope level LEV is written are cleared up; and the writing of the group of rates RTj, the group of break instant levels LBPj, first variation rates RTS, second variation rates RTA and the attack level LATK into the registers RTjR, LBPjR and a register LATKR, respectively, and also the setting of "1" to the registers EV-ATR, EV-ENDR and the various flags.)

Assignment to the tone-generating channels, that is, assignment to the musical tone-allocating channels, is executed as follows:

(I) If a tone-generating channel is found which has finished generation of a previous tone and is released at an instant when the following detection is performed, then this tone-generating channel is assigned again to a next musical tone in the aforementioned manner and the process goes to Step N. The detection is carried out by checking the states of key state flags KYS written in the registers KYSR for the musical tone-allocating channels and also by concurrently checking the states of envelope completion flags EV-END written in the registers EV-ENDR for the envelope waveform-producing channels.

(II) In case where any released tone-generating channel is not found out, search is performed to find out such a tone-generating channel that is generating a tone at the lowest envelope level LEV after completion of its attack part A. The search is conducted by checking the state of envelope levels LEV written in the registers LEVR of the waveform-producing channels, and by concurrently checking the state of attack-part end flags EV-AT written in the registers EV-ATR of the waveform-producing channels. The tone-generating channel searched in this way is assigned to generate the next musical tone and the process goes to Step N. The register LEVR is reset to cease generation of the musical tone in this case, but a processing causing an accelerated attenuation will be more desirable M. The received data RCVD is key-off data if it proves in the decision in Step I to have the value of "8H" as to four leading bits in the first byte STAT, or if it proves in the decision in Step J to have the value of "00H" as to its third byte DAT2 The following key-off processing is executed on such a received data RCVD.

Reference is made to a key code BKYC that is included in a key data BKYD written in a register BKYR, and to a signal-receiving channel number "n" written in a signal-receiving channel buffer BnR. Reference is also made to the key code KYC, the key state flag KYS and the signal-receiving channel number "n" respectively written in the registers KYCR, KYSR and nR. Subsequently determined is a tone-allocating channel for which the key code BKYC is identical with the key code KYC, the key state flag KYS has a value of "1" showing key-depression, and the signal-receiving channel numbers "n" coincide with each other. Then, the key-off envelope in-processing flag RKOF is set "1" showing that a key-off envelope processing is going on, and the value of the key state flag KYS is changed to "0" showing a key-off state so as to command initiation of the key-off processing. The process then returns to Step E.

In the case where such a musical tone-generating channel as described just above is not detected, the process goes back directly to Step E.

N. This step is a preferential order-shifting subroutine that will be described later in detail referring to FIG. 9. The process returns to Step E after this subroutine has finished.

Figure 8:
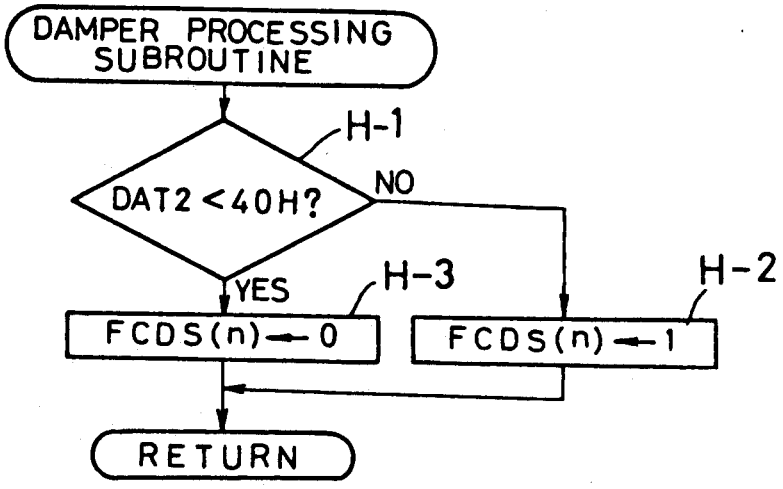

The damper processing subroutine (Step H) will now be described in detail with reference to FIG. 8 in a step-by-step manner.

H-1. Decision is made on whether or not a value of the third byte DAT2 that is included in the received data RCVD written in the register RCVDR is less than "40H". If the value of the third byte is less than "40H", then the process goes to Step H-3.

H-2. If in the Step H-1 the value of third byte DAT2 is judged not to be less than "40H" with the received data RCVD corresponding to a state of damper "ON" (i.e., damper pedal being pressed down), then value "1" borne by the damper state flag FCDS(n) to indicate a pressed down damper pedal is written into the register FCDS(n)R that corresponds to the signal-receiving channel number "n" written in the signal-receiving channel buffer BnR, thus ending here this subroutine.

H-3. If, on the contrary, the value of third byte DAT2 is less than "40H" with the received data RCVD corresponding to a state of damper "OFF" (i.e., a damper pedal being released), then "0" borne by the damper state flag FCDS(n) to indicate a damper pedal not pressed down is written into the register FCDS(n)R that corresponds to the signal-receiving channel number "n" written in the signal-receiving channel buffer BnR, thus ending here this subroutine.

Figure 9:
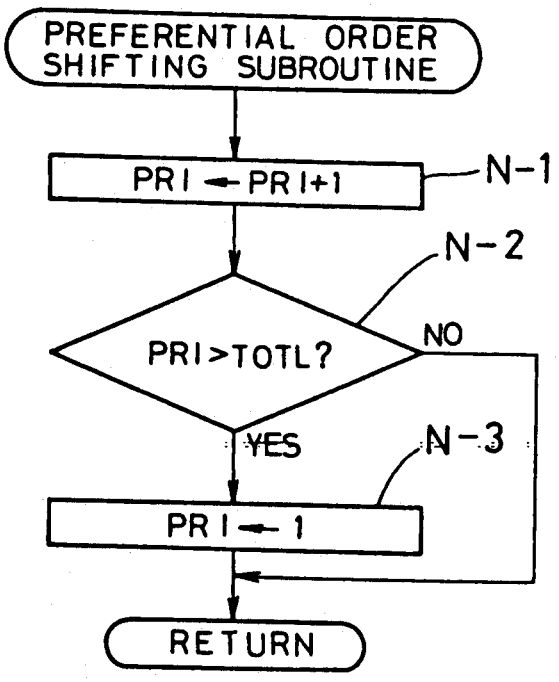

The preferential order-shifting subroutine (Step N) will now be described in detail with reference to FIG. 9 in a step-by-step manner.

N-1. New preferential order data PRI are produced by adding "1" to the old preferential order data PRI and written into the registers PRIR.

N-2. Decision is made on whether or not any preferential order data PRI written in the registers PRIR has exceeded the incorporated-components data TOTL written in the register TOTLR. If any preferential order data PRI has not exceeded the incorporated-components data TOTL, then this subroutine ends.

N-3. In case where any preferential order data PRI is judged in the decision of Step N-2 to have exceeded the incorporated-components data TOTL, the data PRI is reset at "1" and this "1" is written into the corresponding register PRIR to thereby end this subroutine.

Figure 10:
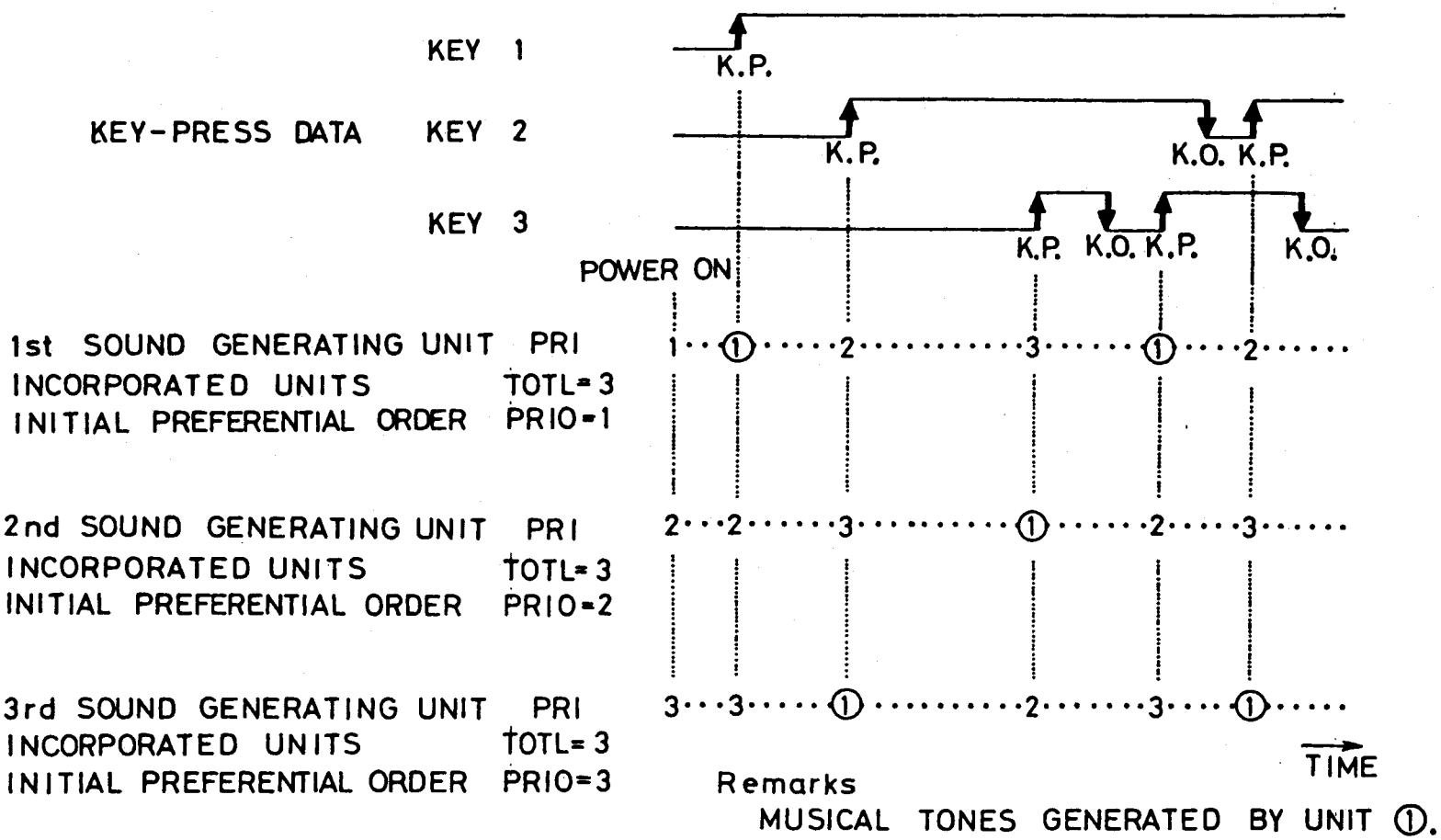

In summary, the subroutine just described above is so designed that the preferential data PRI are incrementally increased each time when the key-press data is received, whereby any preferential data PRI which has exceeded the incorporated-components data TOTL is reset at "1". Accordingly, in the first embodiment employing three sound generating units S, the preferential order data PRI that are assigned thereto change their values upon each receipt of key-press data as shown in FIG. 10. Only such a sound generating unit S for which the value of preferential order data PRI is set at "1" at a given instant does generate sound on the basis of judgment that the key-press data received at that instant is valid. In this way, all of the incorporated sound generating units S can generate sounds in turn such that none of them is allowed to more frequently generate sound than the remaining ones do, thus leveling all the sound generating units S with respect to the number of generated sounds. In other words, the number of actually generated sounds at each instant is kept equal to the number of incorporated sound generating units S, no matter what key codes may be received, thus providing a sufficient effect of increasing the effective sources of sounds.

As a modification of the system described above, the initial values PRIO of preferential orders may be reset as the preferential order data PRI onto the registers PRIOR in the event that all the keys were released. This arrangement will be useful for re-normalization of preferential orders that might become out of order occasionally due to alterations made by a user of this system on the incorporated-components data TOTL or on the initial values PRIO of preferential orders. Further as another modification, the incorporated-components data TOTL as well as the initial values PRIO of preferential orders may be input to and written into the microcomputer 22 by means of the input interface 20 without using the components-in-total switch 24. The so-called daisy chain may be employed to establish a mutual communication link between the incorporated sound generating units S that are connected to each other by means of the MIDI. A data relating to such connections may, in this communication link, be sent successively from one to another sound generating units S so as to enable an automatic detection by themselves of the incorporated-components data TOTL to thereby automatically set up the data TOTL and the initial values PRIO of preferential orders.

Although the signal-receiving channel numbers "n" are predetermined for respective timbres in the first embodiment, said numbers "n" may be assignable to the timbres at the user's discretion. And in such a case, the same signal-receiving channel may be allotted to each sound generating unit S as to one and the same timbre. Another total number of timbres may be adopted instead of eight (8) set up beforehand in the first embodiment.

Although the preferential order data PRI are renewed at each key-depression in order to cause the sound generating unit S whose preferential order data PRI is "1" to generate sound, the user may choose any initial value PRIO of preferential orders to activate from time to time the sound generating units whose preferential order data PRI is judged to correspond to the chosen value PRIO. All of the preferential order data PRI of all the sound generating units S should, in such a case, be selected beforehand such that they are cleared up at the same time when the power supply is turned on or all the keys are released. Further in such a case, the initial values PRIO may be set up mechanically, for instance by means of a rotary switch or anything else, instead of charging them to the RAM 22C to be stored therein.

As for the number of the sound generating units S, it is possible to incorporate six (6) such units in an enlarged system, though the system in the first embodiment comprises merely such sound generating units S that cannot receive the signals from the signal-receiving channels No. 8 to No. 15 but can receive those from the channels No. 0 to No. 7. In the enlarged system, a group "A" consisting of three sound generating units S may be assigned to the signal-receiving channels No. 0 to No. 7 whereas another group "B" consisting of the other three sound generating units S' are assigned to the channels No. 8 to No. 15. In this system, numeral "3" as the incorporated-components data TOTL together with other numerals "1", "2" and "3" as the sequential initial values PRIO of the preferential orders are allotted to the former group "A" of the units S. And also allotted to the latter group "B" of the units S' are similar initial values PRIO of preferential orders whereby note-on messages to the signal-receiving channels No. 0 to No. 7 cause the group "A" of sound generating units S to sequentially generate sounds while the other note-on messages to the channels No. 8 to No. 15 causing the group "B" of the sound generating units S' to generate sounds.

As described hereinbefore, the first invention is applied to the first embodiment in which a musical tone-generating circuits is installed in each sound generating unit. However, the systems may be modified in such a manner that the performance controlling messages are selected to be supplied to a plurality of outside musical tone-generating circuits.

SECOND EMBODIMENT

This embodiment is adapted to the processing of consecutive depressions of one and the same key in such a system as in the first embodiment in which, as described hereinbefore, a plurality of sound generating units are incorporated in combination to increase a total number of generated sounds per unit period of time. The consecutive depressions just referred to above means that a key is depressed again to generate a new key-press data for a musical tone or sound in order to superpose this sound upon an old sound that has been and is still being generated according to old key-press data by a previous depression of the same key. The same signs, numerals or names as those in the first embodiment denote here the same steps, parts or members as those in the first embodiment, and only such features that differ from those in the first embodiment are explained to avoid redundancy in description. The second embodiment relates to such sound generating units S that generate sounds of decaying type (percussive type).

A scheme of the sound generating units S in this second embodiment is also given in FIG. 2 and thus is of almost the same nature as is those in the first embodiment. However it differs from those in the first embodiment in the point that a tone generating circuit 28 has thirty two (32) tone-generating channels.

It is assumed that each musical tone or sound generated in the second embodiment is composed, as is a sound generated by the piano, of (a) a first constituent tone A and (b) a second constituent tone (B) following the first constituent tone A. The first constituent tone A mainly corresponds to an initiation part of the tone (i.e., an attack part "A" plus a decay part "B" in ADSR representation as shown in FIG. 7), the initiation part composed of a key-hammering sound and a string-striking sound which is generated immediately after the striking of a string and has a higher content of harmonic components. The second constituent tone B mentioned above mainly corresponds to a continuing part (i.e., a sustain part "S" plus a release part "R") which gives a feeling of generated volume of the tone, and consists of a string sound which has a lower content of harmonic components and a lesser degree of change in timbre. It is also assumed in the second embodiment that in order to produce each musical tone signal, the first constituent tone A and the second constituent tone B are respectively generated in different tone-generating channels. In other words, the tone generating circuit 28 comprises thirty two (32) tone-generating channels wherein first and a second channels constitute a group, third and a fourth channels constitute another group, and so on . . . , then a thirty first and a thirty second channels constitute a still further group. Each of the tone-generating channels carrying even ordinal numbers are assigned to the first constituent tones whereas each of the tone-generating channels carrying odd ordinal numbers are assigned to the second constituent tones so that they respectively produce musical tone signals.

Figure 11:
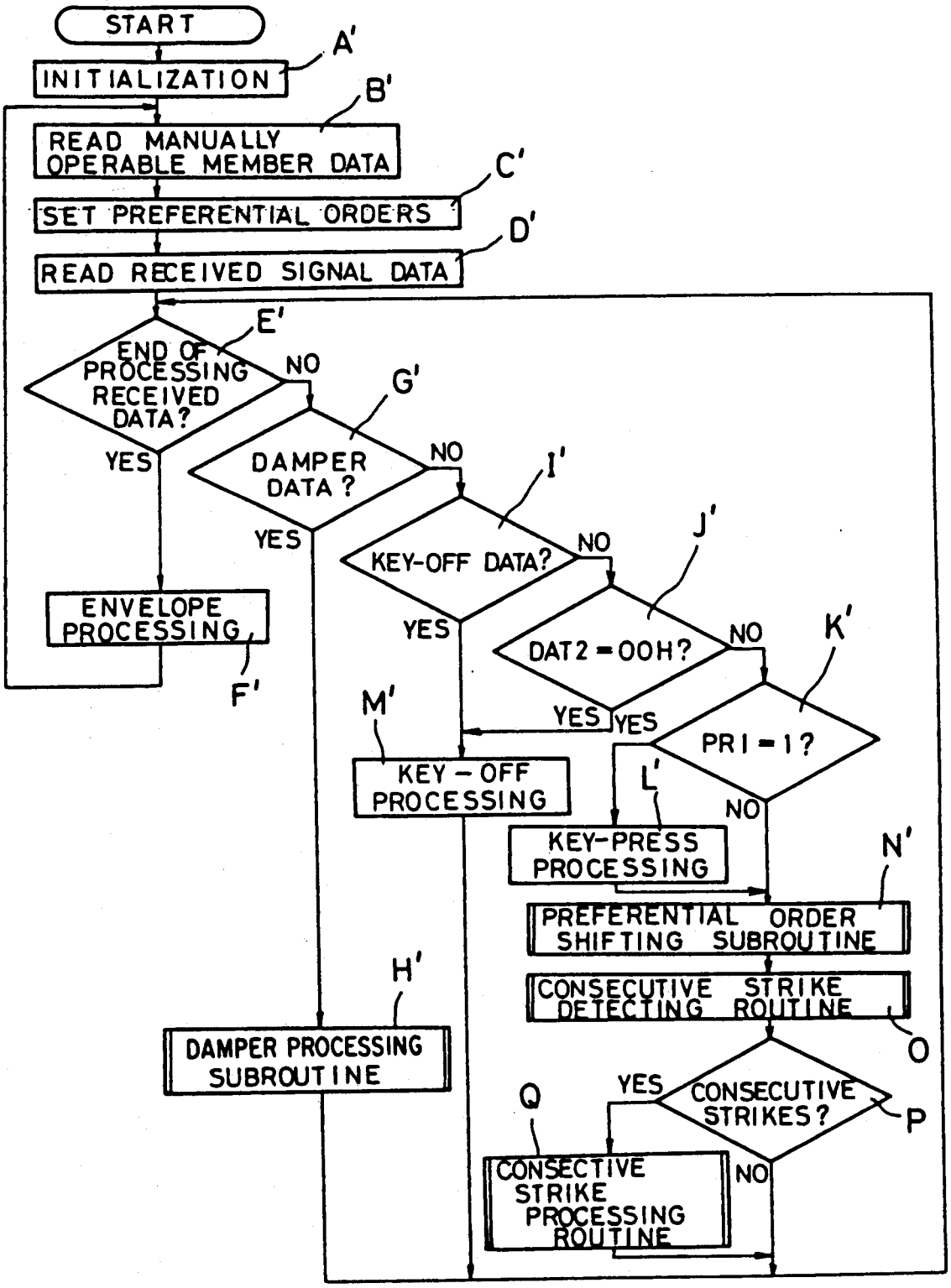

The tone generating units S constructed as above in the second embodiment executes such a basic program as represented by a flow-chart shown in FIG. 11. Differences between each step in the second embodiment and each corresponding step in the first embodiment will now be explained in detail.

A'.-E'. These steps are identical with the Steps A to E in the first embodiment.

F'. In addition to the procedure (I) of Step F in the first embodiment, calculated and produced here based on a group of parameters GTEm(n) relating to generation of musical tones such a first variation rate RTS that indicates minus variations per unit time in changing the envelopes. The first variation rate RTS is also one of envelope parameters and is set up for each envelope waveform producing channel. Therefore, a register RTSR is provided for each envelope wave-form producing channel in order that the first variation rate RTS is written into and read from the register RTSR.

Figure 12:
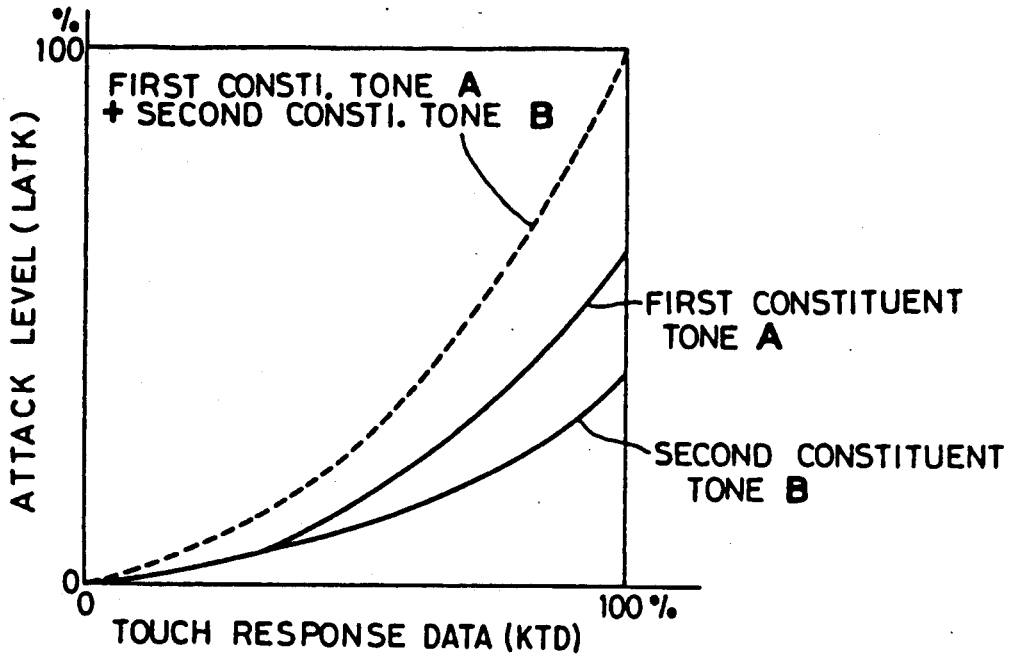

Attack levels LATK are produced by means of a conversion table that has been stored in a ROM 22B corresponding to and based on a touch-response datum-attack level conversion graph shown in FIG. 12 instead of that shown in FIG. 6.

G'.-J'. These steps are identical with the Steps G to J in the first embodiment.

K'. This step differs from Step K in that the content of a register BCHR is cleared up so that assigned-channel numbers BCH in this register are reset at their initial states indicating no channel numbers assigned, before the decision in Step K is made.

L'. A difference between this step and Step L in the first embodiment is as follows.

Assignments to musical tone-generating channels, that is, assignment to musical tone-allocating channels, are performed similarly to that in the first embodiment but to the groups respectively consisting of: the first and the second channels; the third and the fourth channels; . . . ; and then the thirty-first and the thirty-second channels. The assignment comprises the writing of said first variation rates RTS into the register RTSR in addition to the procedures of Step L in the first embodiment. Commands are given to each group of the tone-generating channels to commence generation of musical tones, and the channel numbers to which the second constituent tones B were assigned are, as the assigned-channel numbers BCH, written into the register BCHR. And, before going to Step N', reset are such timers TST that count up time lapses after the assignment of musical tones, the timers being written into registers TSTR that are installed within a timer circuit 22D according to the musical tone-allocating channels. Then, the process goes to Step N'.

M'. This step is identical with Step M in the first embodiment.

N'. Although a content itself of this step is identical with the preferential order-shifting subroutine in Step N of the first embodiment, the process in this second embodiment goes to Step O after completion of Step N'.

O. Detecting routine of consecutive strikes: If consecutive strikes are detected, then a "1" appearing on an consecutive-strike detecting flag DMPF to indicate initiation of a changing processing is written into a register DMPFR. Details thereof will be described later referring to a flow-chart shown in FIG. 13.

P. A decision is made as to the occurence of consecutive strikes based on whether the consecutive-strike detecting flag DMPF that is written in the register DMPFR is or is not indicating "1". If the flag DMPF is indicating "0" meaning no initiation of a changing processing, then the consecutive strikes are not judged to be taking place and therefore the process returns to Step E'.

Figure 14B:
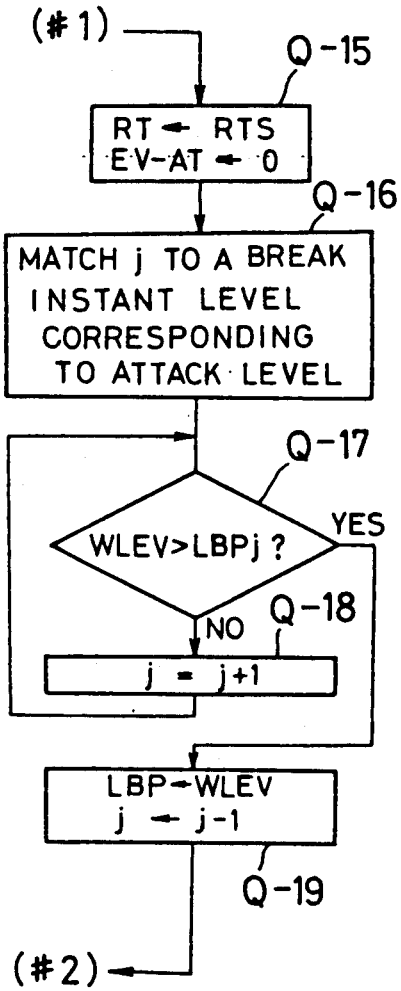
Figure 14A:
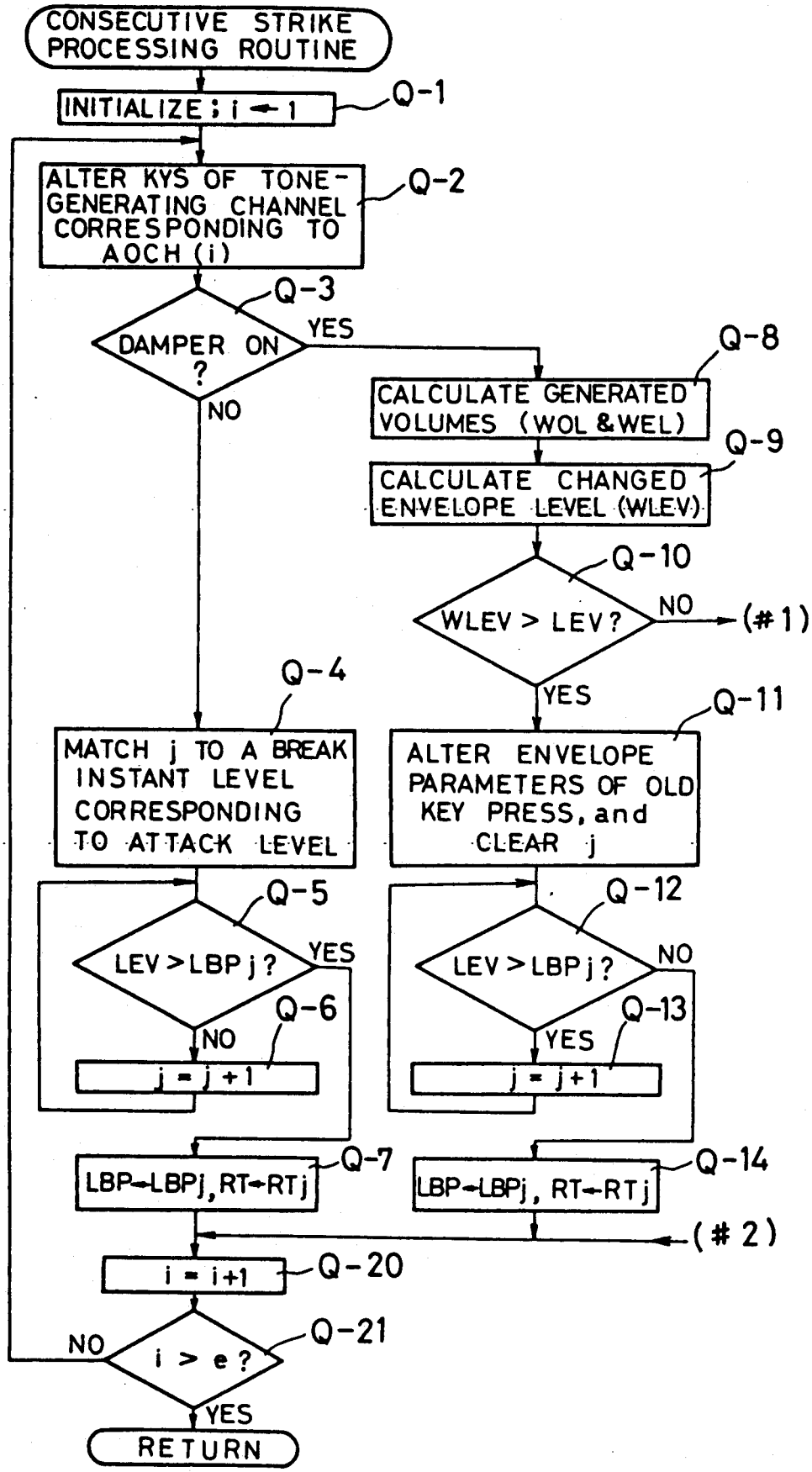

Q. In the case where the decision in Step P affirms the initiation of the changing processing and the occurence of the consecutive strikes based upon "1" appearing on the consecutive-strike detecting flag DMPF, the process will begin a consecutive-strike processing routine. This consecutive-strike processing routine will be described later in detail referring to a flow-chart shown in FIGS. 14A and 14B.

The process returns to Step E' after completion of the consecutive-strike processing routine.

Figure 13:
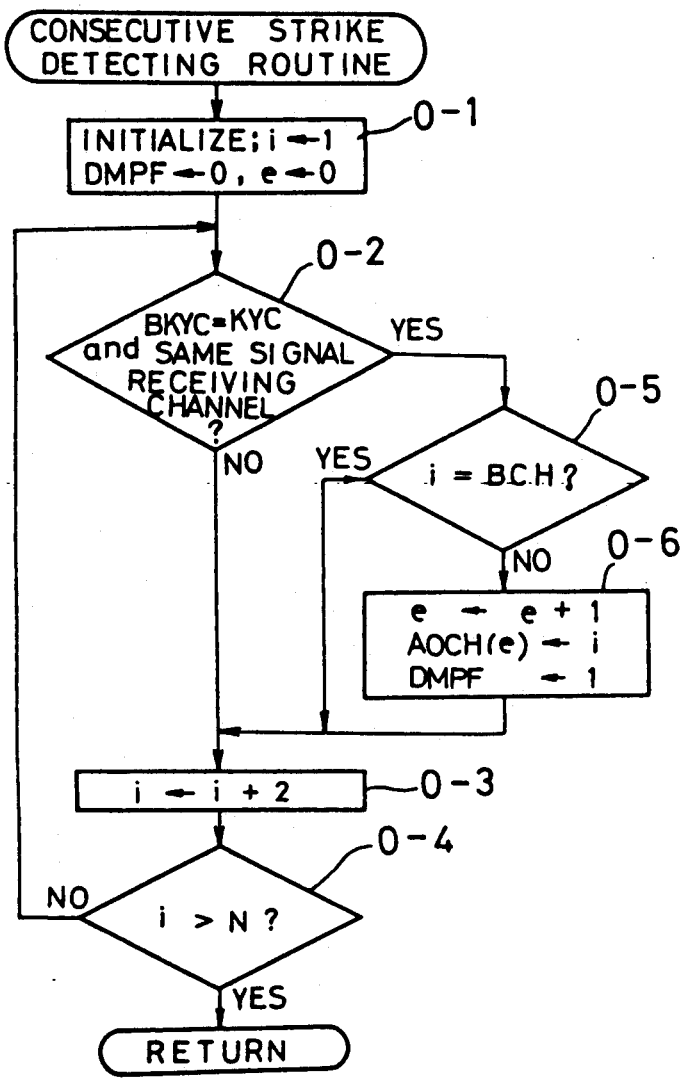

Now, the consecutive-strike detecting routine (Step O) is described for each step therein referring to FIG. 13.

The detecting of consecutive strikes is performed as to the second constituent tones B and by searching musical tone-generating channels that are actually generating musical tones caused by the same key.

O-1. Initialization is carried out by setting to "1" the number of loops "i" written in a register iR, by setting to "0" the consecutive-strike detecting flag DMPF wherein "0" indicates a state that any consecutive strikes are not detected, and by setting to "0" a total number "e" of old key-presses subject to the consecutive-strike processing, which number "e" is written in a register eR.

O-2. A decision is made as to whether or not the key code BKYC of a newly depressed key (hereinafter referred to as "new key-press") in suitable consecutive strikes which key BKYC is written into BKYCR, and the key code KYC written into the register KYCR of the musical tone-generating channel of the channel number corresponding to the number of loops "i" written into the register iR are the same. And, if "Yes", a further decision is made as to whether or not the signal-receiving channel number "n" written into the signal-receiving channel buffer BnR, and the signal-receiving channel number "n" written into the register nR of the musical tone-generating channel number corresponding to the number of loops "i". If the key code BKYC of the new key-press and the key code KYC are the same, and the signal-receiving channel numbers "n" are identical with each other, then the process goes to Step O-5.

O-3. Where the key code BKYC of the new key-press and the key code KYC are not the same in the decision in Step O-2, "2" is added to the number of loops "i", and the number after the addition is written into the register iR as the new number of loops "i".

O-4. The number of musical tone-generating channels N being thirty-two in the present embodiment, which number is stored in the ROM 22B, is compared with the number of loops "i" written into the register iR, and if the number of loops "i" is not larger, the process returns to Step O-2 in a repeated manner, and if the number of loops "i" is larger, no consecutive strikes exist corresponding to all musical tone-generating channels, and therefore the routine is ended.

O-5. Where the key code BKYC of the new key-press and the key code KYC are the same in the decision in Step O-2, and besides, the signal-receiving channel numbers are identical with each other, then a decision is made as to whether or not the number of loops "i" coincides with the assigned-channel number BCH written in the register BCHR. If the number of loops "i" and the assigned channel number BCH are the same, the musical tone-generating channel of the number of loops "i" has been already assigned in Step L' and already judged to correspond to the consecutive strikes. Therefore, this is excluded from the data which are undergoing the present detecting routine, and the process goes to Step O-3. In case where such an accelerated attenuation is performed in assignement of musical tone-generating channels in the processing of key-press data as described in paragraph (II) of Step L', the musical tone-generating channel, which has been relating to the accelerated attenuation, is also excluded from the data which are undergoing the present detecting routine.

O-6. Where the number of loops "i" does not coincide with the assigned-channel number BCH written in the register BCHR, "1" is added to the total number of the old key-presses "e", and a value obtained by the addition is written into the register eR as a new total number of the old key-presses. Then, the key the data of which is processed as above is considered to be the previously depressed key (hereinafter referred to as "old key-press") in suitable consecutive strikes, and the number of loops "i" denoting the channel number of the old key-press is written into a register AOCH(e)R as a channel number AOCH(e). This "e" will, after completion of the present routine, indicate a total number of old key-presses that has been treated as those included in the consecutive strikes. However, during the present routine, the value "e" shows the "e"th tone-generating channel among those channels allotted to the old key-presses that have been detected to be included in the consecutive strikes. Further, "1" is set to the consecutive-strike detecting flag DMPF in order to indicate that the consecutive strikes have been detected, and is then written into the register DMPFR. The process goes to Step O-3 after Step O-6 has ended.

In the detecting routine of consecutive strikes, in short, there is searched among all the tone-generating channels, by means of the second constituent tone B, such a musical tone-generating channel that is generating an effective tone and that corresponds to the same timbre which has been assigned to the same signal-receiving channel, and the channel number of that musical tone-generating channel is written into the register AOCH(e)R as the channel number AOCH(e) of the old key-press, and the consecutive-strike detecting flag DMPF is set to "1" showing that the consecutive strikes have been detected. Therefore, such a tone-generating channel that corresponds to a tone generation of a shortened duration due to the command which has ordered an initiation of the accelerated attenuation in the consecutive-strike processing, is excluded from the tone-generating channels to be treated as above.

Next, the consecutive-strike processing routine (Step Q) will be described in detail for each step thereof referring to FIG. 14. The second constituent tones B of the old key-presses are assigned to such tone-generating channels which are to be treated by this consecutive-strike processing routine, and which have been detected in the consecutive-strike detecting routine (Step O) and have the channel numbers AOCH(e) of old key-presses written into the register AOCH(e)R. In other words, the following processing relates to registers that are installed for the second constituent tones B of old key-presses and that correspond to those tone-generating channels which bear the channel numbers AOCH(e) written in the aforementioned registers AOCH(e)R.

Q-1. The number of loops "i" written in the register iR is made "1" for initialization, and a tone-generating channel to which is assigned a second constituent tone B of an old key-press to be treated is hereby assigned newly to the tone-generating channel having a number AOCH(1) for another old key-press that is written in a register having a number AOCH(1)R (i.e., AOCH(i)R, i=1), instead of being assigned to another old key-press tone-generating channel AOCH written in a register AOCHR.

Figure 15:
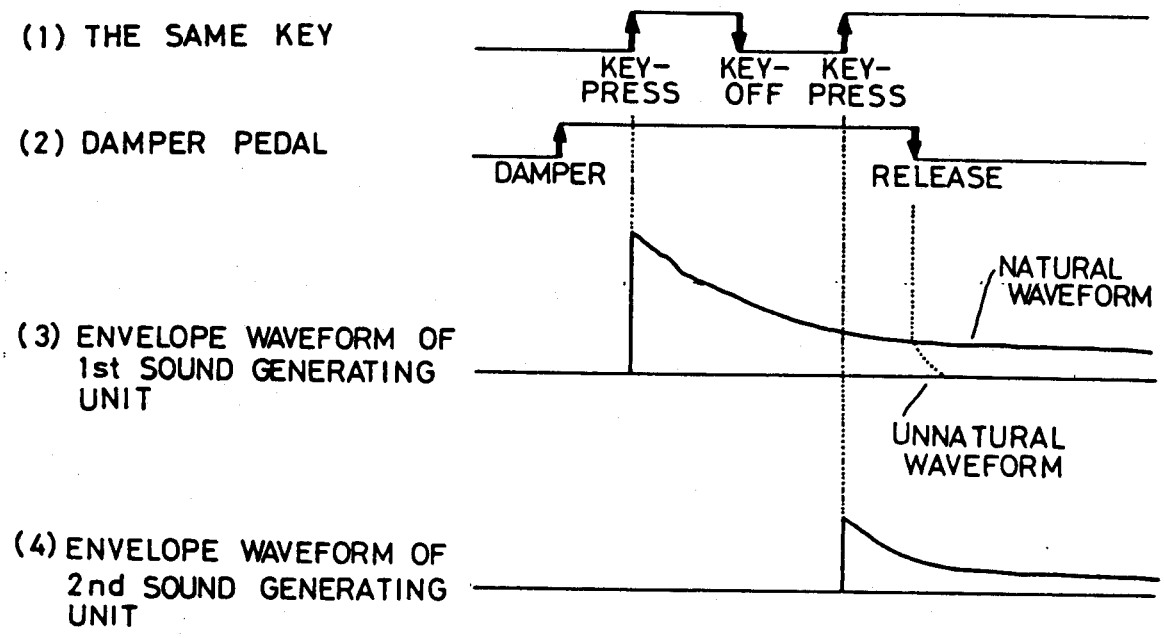

Q-2. A "1" showing a key-depression is substituted for "0" showing a key-off state as to the key state flag KYS, and written into the register KYSR, even if the flag in said register has been showing "0" regarding the tone-generating channel that corresponds to a channel AOCH(i) of the old key-press. This treatment, as shown in FIG. 15, is performed in order that, in the case where one and the same key is consecutively struck two times while a damper pedal is being depressed, a first musical tone generated by a first or previous key-depression shall not quickly decay or die away when the damper pedal is released after the second striking of the key (as illustrated at (1) and (2) in FIG. 15). In the event that such a treatment would not be performed, the tone generating unit S which has generated sound in response to the first key-depression would not generate sound at an instant when the second key-depression were given as to the same key, because a key-off state appears at that instant for the unit S after the first key-depression. Thus, in such a hypothetical event, the musical tone generated by the first key-depression would suddenly die away in an unnatural manner (as indicated at the broken line on an envelope waveform of the musical tone generated by the first unit S, in FIG. 15, (3)). Therefore, in the present embodiment, the musical tone-generating channel is recovered to its key-depression state if this channel is at a key-off state when the consecutive strikes are detected, whereby such a quick decay is avoided even if the damper pedal were released in the aforementioned manner.

Q-3. A decision is made as to whether or not a damping processing is inhibited by a continuing depression of the damper pedal when the key is released. This decision is based on the damper state flag FCDS(n) written in the register FCDS(n)R that corresponds to the signal-receiving channel "n" written in the signal-receiving channel buffer BnR. The process goes to Step Q-8 if the damping processing is judged to be inhibited due to "1" on the damper state flag FCDS(n) showing that the damper pedal is depressed (i.e., "Damper ON").

Q-4. Where, in the decision in Step Q-3, the damper state flag FCDS(n) indicates "0" showing that the damper pedal is not depressed (i.e., "Damper OFF") and therefore the damping processing is not inhibited, then a final envelope step "j" of the attack part "A" is written into the register jR, the envelope step "j" corresponding to a predetermined break instant level LBPj equal to the attack level LATK.

Q-5. A decision is made as to whether or not the envelope level LEV of the second constituent tone B of the old key-press, the level LEV being read from the register LEVR of the musical tone-generating channel which corresponds to the old key-press channel AOCH(i) written in the register AOCH(i)R, is larger than the break instant level LBPj written in the register LBPjR that corresponds to the envelope step "j" written in the register jR. If the envelope level LEV is larger than the break instant level LBPj, then the process goes to Step Q-7.

Q-6. Where, in the decision in Step Q-5, the envelope LEV of the second constituent tone B of the old key-press is not larger than the predetermined break instant level LBPj corresponding to the envelope step "j", then "1" is added to the envelope step "j" to produce a new value of the envelope step "j" written thereafter into the register jR, and the process returns to Step Q-5.

Q-7. Where, in the decision in Step Q-5, the envelope level LEV of the second constituent tone B of the old key-press is larger than the predetermined break instant level LBPj corresponding to the envelope step "j", then this break instant level LBPj is written into the register LBPR, the rate RTj is written as the rate RT into the register RTR, and thereafter the process goes to Step Q-20.

Figure 16:
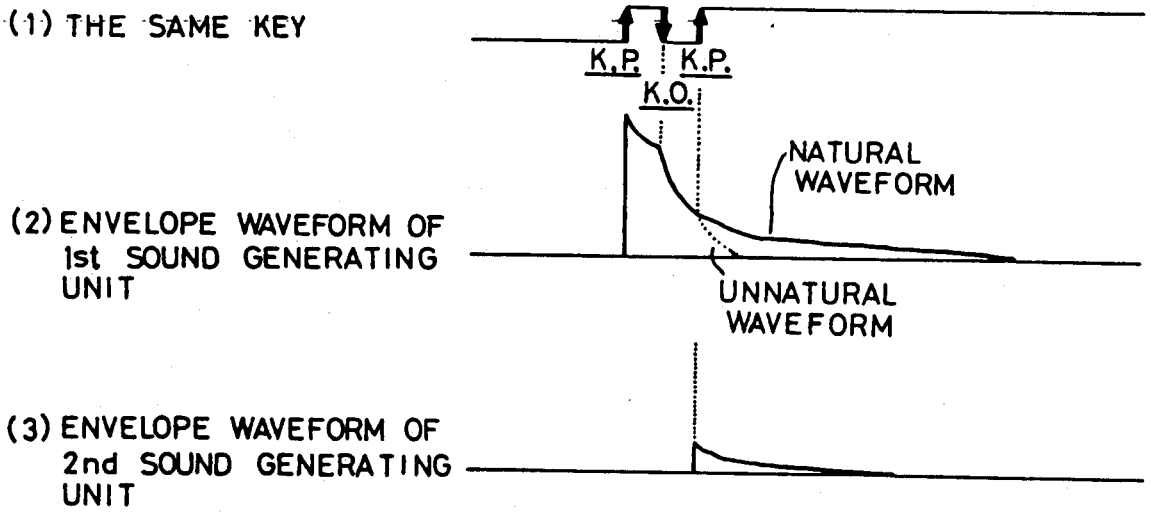

The above Steps Q-4 to Q-7 are those which change the envelope of the musical tone in its released state into the envelope of a sustain state, based on the current envelope level LEV. This treatment simulates a phenomenon that a new key-depression releases a string damper thereby re-initiating a long-lasting decay process if the new key-depression is made before the musical tone that has been generated by the old key-depression has perfectly died away. Thus, a weaker key-depression made immediately after a stronger key-depression, as shown in FIG. 16, will not cause a incongruous and sudden decay of the musical tone.

Q-8. Where, in the decision in Step Q-3, the damper state flag FCDS(n) indicates "1" showing that the damper pedal is not depressed (i.e., "Damper ON") and therefore the damping processing is inhibited, the simulation of the envelope of the second constituent tone B is performed on the supposition that a new key-depression was made, and a generated volume WOL of the second constituent tone B of the old key-press as well as a residual generated volume WEL of said second constituent tone B. The abovementioned simulation is such a treatment that the envelope parameters necessary for production of the predetermined envelope waveform are calculated at high speed to follow a process of generation of the envelope waveform, based on the key code BKYC (KYC) and touch-response data BKTD (KTD) read from the table in ROM 22B, and also based on the parameter groups GTEm(n) concerning the generation of musical tone and corresponding to the signal-receiving channel No. "n" that is written in the register nR which corresponds to the second constituent tone B to be processed.

(1) The envelope waveform of a second constituent tone B that is to be generated by the old key-press is simulated to determine such a second constituent tone B that exists at an instant of t=T1+T2 when the envelope waveform of the second constituent tone B produced by the new key-press has passed through the attack part "A". In other words, such an envelope level LEV(t) of the tone-generating channel No. "AOCH(i)" written in the register AOCH(i)R for the old key-press is determined, and thereafter the envelope level LEV(t) is written into a register WOLR, as the generated volume WOL of the second constituent tone B by the old key-press.

$$WOL=LEV(t),\ t=T1+T2$$

There may be employed an approximation in the above procedure, in which approximation of a current value of the envelope level LEV existing at that instant in the register LEVR as to the second constituent tone B of the old key-press is used in place of the abovenoted LEV(t). If, however, the envelope waveform of the second constituent tone B by the old key-press has not yet passed through the attack part "A", then the attack level LATK of said second constituent tone B may be used in place of the envelope level LEV(t).

T1: The time lapse from musical tone assignment of a new key-press to an instant when the attack part "A" has completed as to the envelope waveform of the second constituent tone B by the new key-press.

T2: The time lapse from musical tone assignment of the old key-press to musical tone assignment of a new key-press.

(The time lapse T1 is evaluated by simulating the envelope waveform of the second constituent tone B; and the time lapse T2 is obtained by reading the instantaneous value of the timer TST, the value having been counted from the assignment of the old key-press and having been written into the corresponding register TSTR.)

(2) Residual generated volume WEL of the second constituent tone B as to the old key-press:

Since a portion of the energy of the old key-press is lost upon a new key-press, the generated volume of the second constituent B of the old key-press after the new key-press (such a generated volume being the "residual generated volume" referred to as WEL) is decreased to a value of the generated volume WOL of the second constituent tone B of the old key-press that is multiplied by a "residual" factor KD.

$$WEL = WOL \times KD$$

The residual factor KD differs depending upon the way of striking the tone-generating body, the amount of damping of the tone-generating body, the strength of the strike and the like, namely, the key code BKYC(-KYC), touch response data BKTD(KTD) and manually operable member data MNPh. For example, in the case of a piano, hammers strike strongly against strings upon a heavy key-depression and weakly touch them upon a light key-depression, and therefore the residual factor KD differs depending upon the strength of touch (key-press). Also, the amount of damping of the strings differ depending on the tone pitch or the acoustic-wave frequencies of the strings. In other words, though there are conditions affected by the tone pitch, some measures have been taken to reduce undesirable variations of the residual factor KD. For example, in order to prevent the strings from generating unclear tones, the roundness of the heads of the hammers for high-pitch tone parts is made smaller in comparison with those of the hammers for low-pitch tone parts so that the time of contact of the hammers with the strings for higher pitches does not become longer than required. Further, also for decreasing the undesirable variation of KD, a felt covering the hammer heads in the high-pitch parts is made thinner than that which covers those in the low-pitch parts. On the other hand, in a low-pitch tone region, the vibration of strings relative to the movement of hammers cannot be neglected because the undesirable "meeting strike" takes place to offset the movement of the strings. In such a case, the residual factor may be changed by the tone pitch and the interval of key-presses. Or, to make the mechanism simple, random elements can be added. Also, since the effect given differs depending upon the degree of higher harmonics, the residual factor may be changed on a constituent tone basis when the constitution is made with a large number of constituent tones.

In the present embodiment, assuming a fixed decrease of 10%, $$KD = 0.9$$

is employed to simplify the processing.

Q-9. An envelope level WLEV of the second constituent tone B of the old key-press after changing (hereinafter referred to as "changed" second constituent tone B of the old key-press) is calculated and written into a register WLEVR wherein said envelope level WLEV is regarded here to be equal to the residual generated volume WEL of the second constituent tone B of the old key-press.

$$WLEV = WEL$$

Q-10. A decision is made as to whether or not the envelope level WLEV of the changed second constituent tone B of the old key-press, which level WLEV is written in the register WLEVR, is larger than the instantaneous envelope level LEV which is written in the (unchanged) second constituent tone B of said old key-press. If the former envelope level WLEVR is not larger than the latter envelope level LEV, then the process goes to Step Q-15.

Q-11. If, on the contrary, the envelope level WLEV of the changed second constituent tone B of the old key-press is larger than the instantaneous envelope level LEV, that is, the changed second constituent tone B has not yet passed through the attack part "A", then the envelope parameters of the second constituent tone B are calculated based on touch response data WKTD of the changed second constituent tone B of the old key-press in order to cause the envelope of second constituent tone B to correspond to the residual generated volume WEL thereof, in the following manner.

(1) The attack level WATK of the changed second constituent tone B of the old key-press is assumed to be equal to the residual generated volume of the (unchanged) second constituent tone B.

$$WATK = WEL$$

Where, however, the attack level WATK of the second constituent tone B of the new key-press exceeds a maximum value LATKmax of the attack level, an equation:

$$WATK = LATKmax$$

is adopted as an alternative.

(2) Touch response data WKTD of a changed second constituent tone B of the new key-press:

The touch response data WKTD of the changed second constituent tone B of the new key-press is obtained by converting the attack level WATK of the changed second constituent tone B of the old key-press, wherein an inversive conversion table stored in advance in the ROM 22B in accordance with the touch response data KTD- attack level LATK conversion graph. And, the envelope parameters are calculated making use of the thus obtained touch response data WKTD.

Further, the register iR in which the envelope step is written is then cleared.

Q-12. A decision is made as to whether or not the envelope level LEV of the second constituent tone B of the old key-press, which envelope level is read from the register LEVR of the musical tone-generating channel that corresponds to the channel number AOCH(i) of the old key-press written in the register AOCH(i)R, is larger than the predetermined break instant level LBPj written in the register LBPjR that corresponds to the envelope step "j" written in the register jR. If the envelope level LEV of the second constituent tone B of the old key-press is not larger than the break instant level LBPj corresponding to the envelope step "j", then the process goes to Step Q-14.

Q-13. If, in the decision at Step Q-12, the envelope level LEV of the second constituent tone B of the old key-press is larger than the break instant level LBPj corresponding to the envelope step "j", then "1" is added to the envelope step "j" to produce a new value thereof and write it into the register jR before the process returns to Step Q-12.

Q-14. Where in the decision at the decision Q-12 the envelope level LEV of the second constituent tone B of the key-press is not larger than the break instant level LBPj corresponding to the envelope step "j", this break instant level LBPj is written into the register LBPR, and the corresponding rate RTj is set on the register RTR to be written into the register EV-ATR, before the process goes to Step Q-20.

Q-15. Where, in the decision at Step Q-10, the envelope level WLEV of the changed second constituent tone B of the old key-press is not larger than the instantaneous envelope level LEV, the first variation rate RTS having a minus value as the rate RT is written into the register RTR, and "0" is set to the attack-part end flag EV-AT to be written into the register EV-ATR.

Q-16. Then written into the register jR is a final envelope step "j" of the attack part "A" corresponding to the predetermined break instant level LBPj that is equal to the attack level LATK.

Q-17. Further, a decision is made as to whether the envelope level WLEV of the changed second constituent tone B of the old key-press written in the register WLEVR is or is not larger than the predetermined break instant level LBPj that is written in the register LBPjR corresponding to the envelope step "j" written in the register jR. The process advances forward to Step Q-19, if said envelope level WLEV of the changed second constituent tone B of old key-press is larger than said predetermined break instant level LBPj.

Q-18. If said envelope level WLEV of the changed second constituent tone B of the old key-press is not larger than said predetermined break instant level LBPj, in the decision at Step Q-17, then "1" is added to the envelope step "j" to produce a new value to be written into the register jR before the process returns to Step Q-17.

Q-19. Where said envelope level WLEV of the changed second constituent tone B of the old key-press is larger than said predetermined break instant level LBPj, in the decision at Step Q-17, then "1" is subtracted from the envelope step "j" to produce a new value thereof to be written into the register jR, and at the same time the envelope level WLEV of the changed second constituent tone B of the old key-press into the register LBPR.

Q-20. Subsequently, "1" is added to the number "i" that is written in the register iR so as to indicate which musical tone-generating channels are assigned to respective old key-presses, and then the thus produced new number "i" is written into the register iR as an indication of new assignment of tone-generating channels to respective old key-presses. The second constituent tone B of the old key-press to be processed is thereafter assigned to the musical tone-generating channel having a number of AOCH(i) written in the register AOCH(i)R which corresponds to the new number "i" as just described above.

Q-21. Finally, a decision is made as to whether the number "i" that is written in the register iR so as to indicate which musical tone-generating channels are assigned to respective old key-presses is or is not larger than the total number "e" written in the register eR to indicate a total number of the old key-presses. Where the number "i" in the register iR is not larger than the total number "e" of the old key-presses, the process returns to Step Q-2, whereas a decision that the former number "i" is larger than the latter number "e" causes the routine to end.

The above-described consecutive-strike processing routine is such that the envelope waveform is simulated as to the second constituent tone B of the old key-press and the residual generated volume WOL thereof is calculated so that the envelope of said second constituent tone B is changed corresponding to said residual generated volume.

Consequently, the principle of said routine resides in a processing in which the second constituent tone B produced by a key is used to search a musical tone-generating channel that is actually generating a musical tone based upon the same key, whereby a consecutive strike of the key is detected to change the envelope.

In the above second embodiment of the invention, the predetermined first variation rate RTS is used to avoid an intricacy of description. It is however more desirable to calculate and determine such a rate that the envelope comes to the next break instant LBP after the time lapse of T1 (see Step Q-8).

Figure 17:
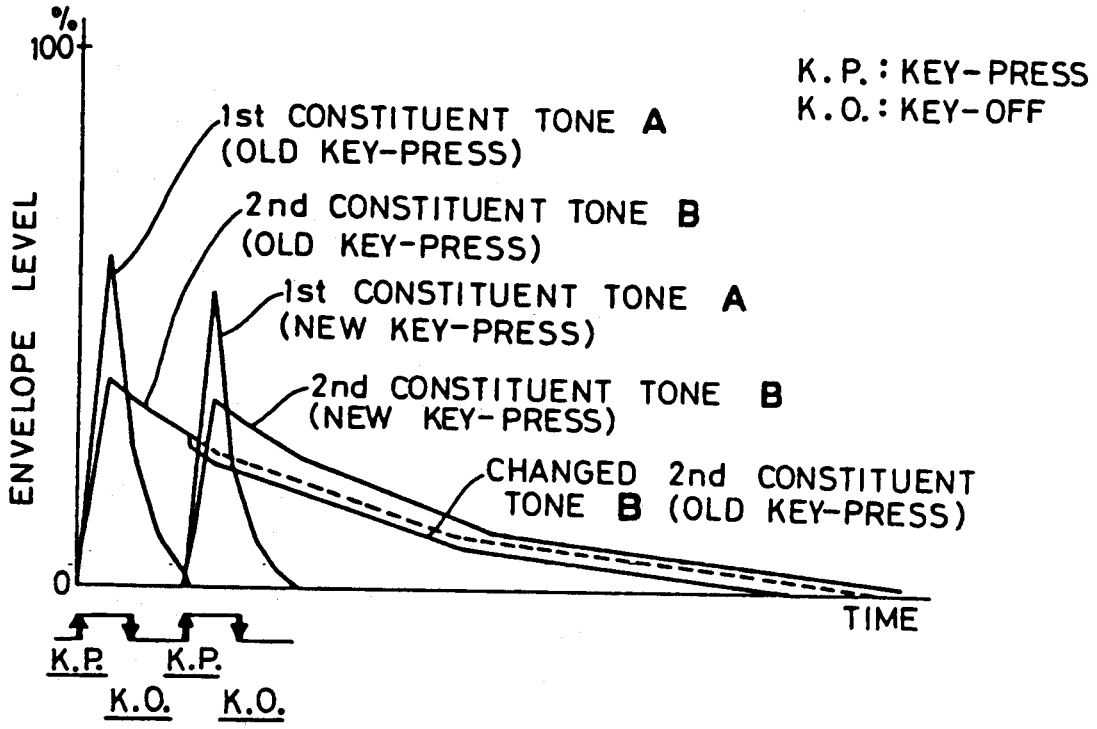
Figure 18:
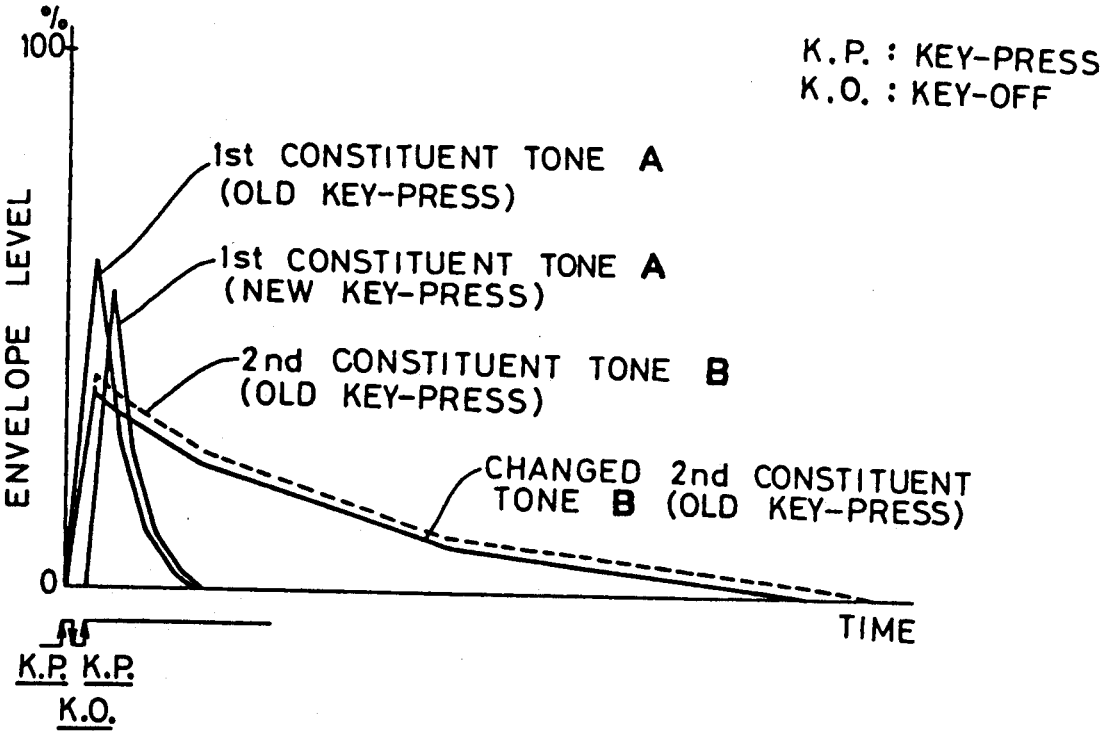

According to the second embodiment of the invention, the musical tone is generated in a manner as shown in FIG. 17 in the case where the envelope level WLEV of the changed second constituent tone B of the old key-press is not larger than the instantaneous envelope level LEV. In contrast therewith, the musical tone will be generated in a manner as shown in FIG. 18 in the case where the envelope level WLEV of the changed second constituent tone B of the old key-press is larger than the instantaneous envelope level LEV. In FIGS. 17 and 18, there is shown a system in which a musical tone based on a new key-depression is generated by one sound generating unit S that is combined with the other sound generating unit S which has been generating a preceding musical tone. It is noted that a second constituent tone B of the new key-depression is not illustrated in FIG. 18 in order to avoid intricacy. The rectangular waves at the bottoms in FIGS. 17 and 18 denote the key-press and the key-off operations performed on the same key to provide the previous and the new key-depressions.

Where a simpler processing is desired, the steps may be omitted which would otherwise be needed when the damping processing is not inhibited due to the damper state flag FCDS(n) indicating "0" to show that the damper pedal is not depressed (i.e., Damper OFF) in the decision at Step Q-3. In other words, the Steps Q-4 to Q-7 may be omitted before the process goes to Step Q-20. Further, if a more precise processing is wanted than in the embodiment, the treatment for changing the residual generated volume may be executed whatever position the damper pedal may be in. In this case, the process is caused to go to Step Q-8 directly from Step Q-2 thereby by-passing Steps Q-3 to Q-7.

Figure 19:
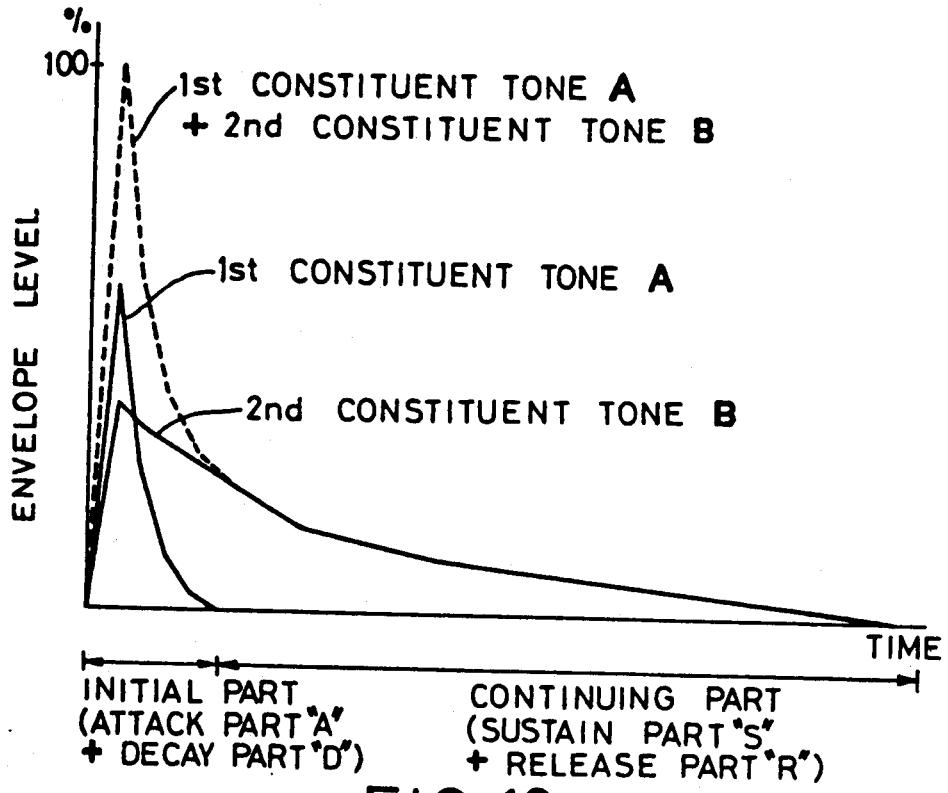
Figure 20:
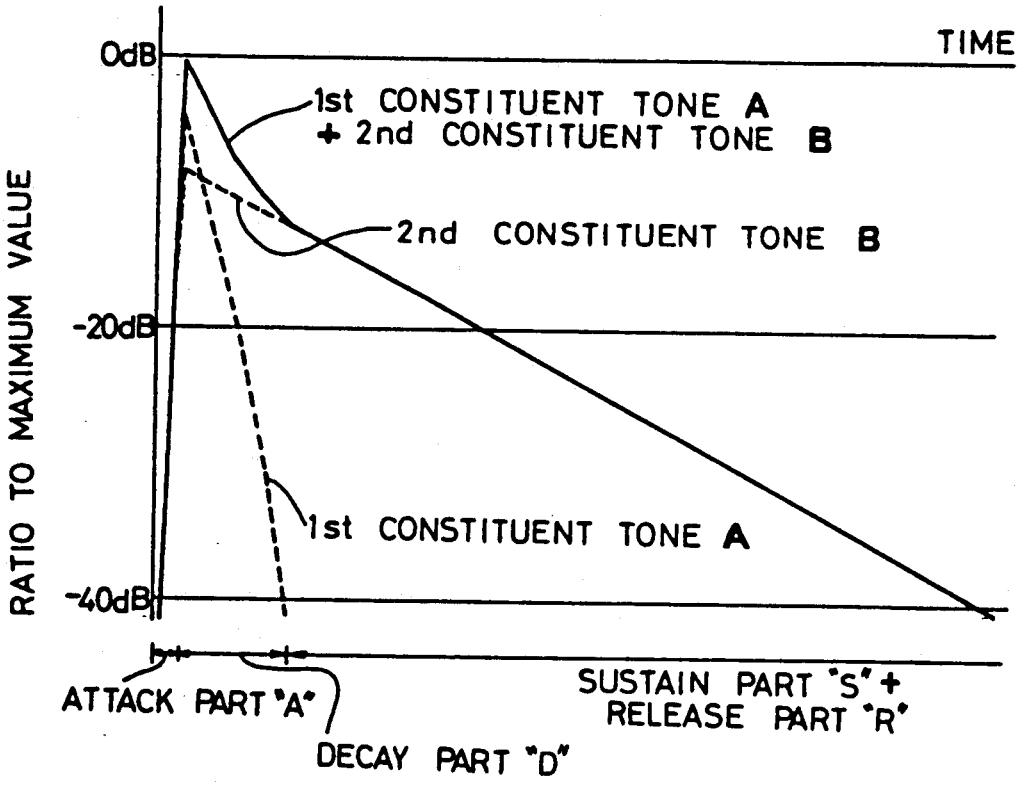
Figure 21:
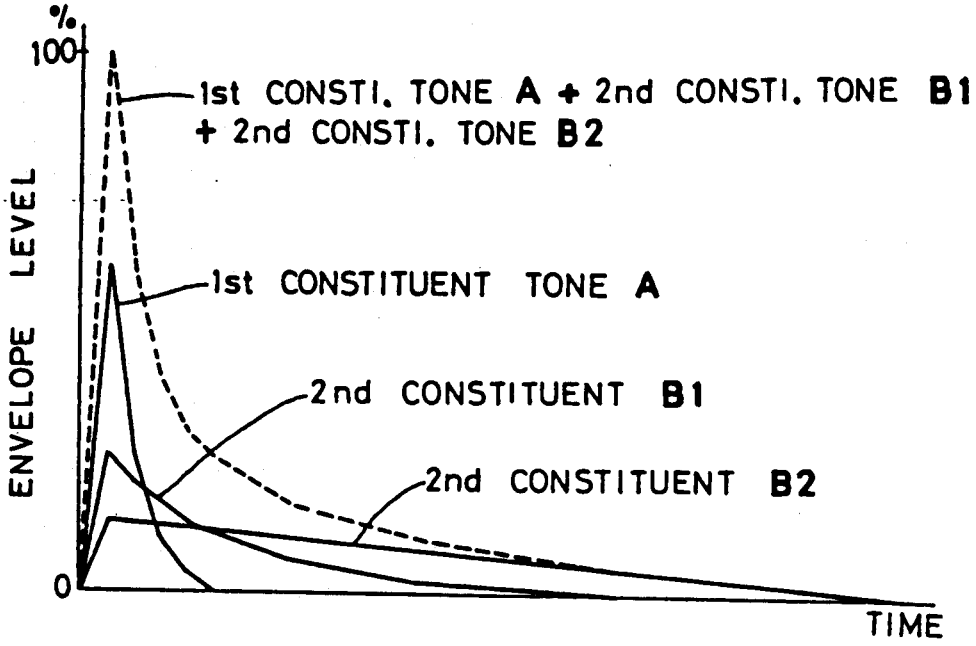

It is also to be noted that the musical tones generated according to the second embodiment have, as illustrated in FIG. 19, a composite waveform that is integrated from a waveform of the first constituent tone A and a waveform of the second constituent tone B. FIG. 20 gives a logarithmic representation of these waveforms wherein the envelope waveform of the second constituent tone B has a constant rate of change per unit time in the course of time, on and after the decay part "D". Therefore, the same keys are deemed to provide such second constituent tones B that have envelope waveforms similar to each other in their shapes on and after said decay part "D".

The second embodiment of the invention employs, as described hereinbefore, the pairs of musical tone-generating channels, each of the pairs comprising one tone-generating channel assigned to the first constituent tone A and the other assigned to the second constituent tone B. But, such pairs have not necessarily to be employed, and instead said tones can be assigned separately to non-paired tone-generating channels since the channels assigned to the tone A are freed earlier than the other channels assigned to the tone B, as apparent from FIG. 20. Such a system will make it possible to more effectively utilize the musical tone-generating channels.

Further, although there are involved different timbres respectively assigned to different signal-receiving channels in the first and the second embodiments, there may be involved only one timbre. All the sound generating units S may, in such a case, be set to an "Omni-Mode-ON" as defined in the MIDI standards wherein all the data (performance controlling messages) are read to sequentially generate musical tones each time the keys are depressed while the preferential orders are concurrently changed. Also, there may be employed some converting apparatuses of such a kind that they respectively and exclusively receive the data corresponding to predetermined signal-receiving channels in order to convert the data, before transmitting them to said sound generating units S, into those which do not include any informations relating to said signal-receiving channels. The sound generating units S in such a case are therefore controlled to generate sounds by such data lacking the informations relating to the signal-receiving channels.

Modified examples of the above second embodiment will now be explained.

MODIFIED EXAMPLE 1

Figure 1A:
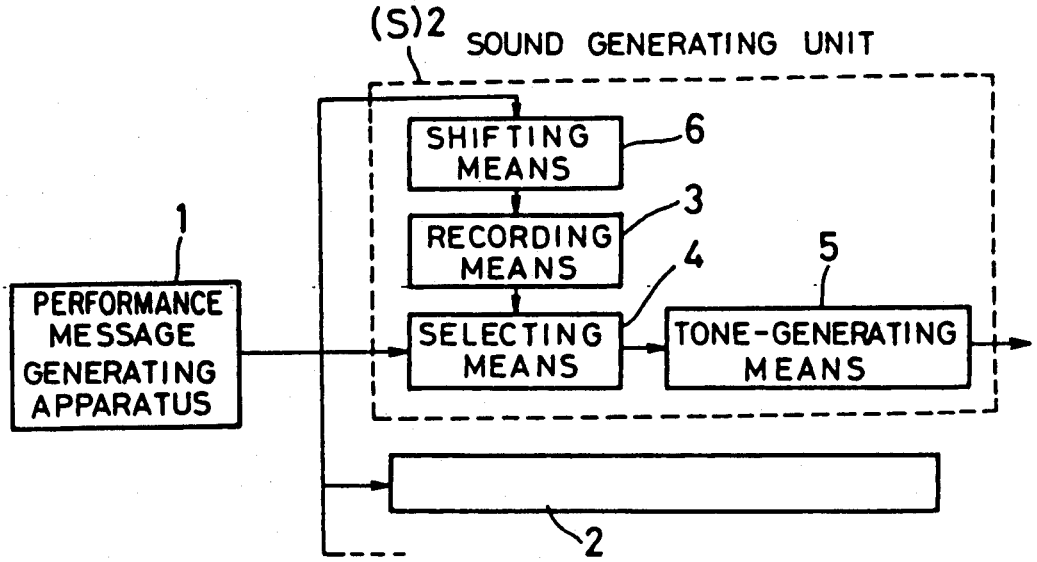
FIGS. 1A and 1B are block schematic diagrams respectively showing systems of electronic musical instruments that are defined in the claims.
Figure 1B:
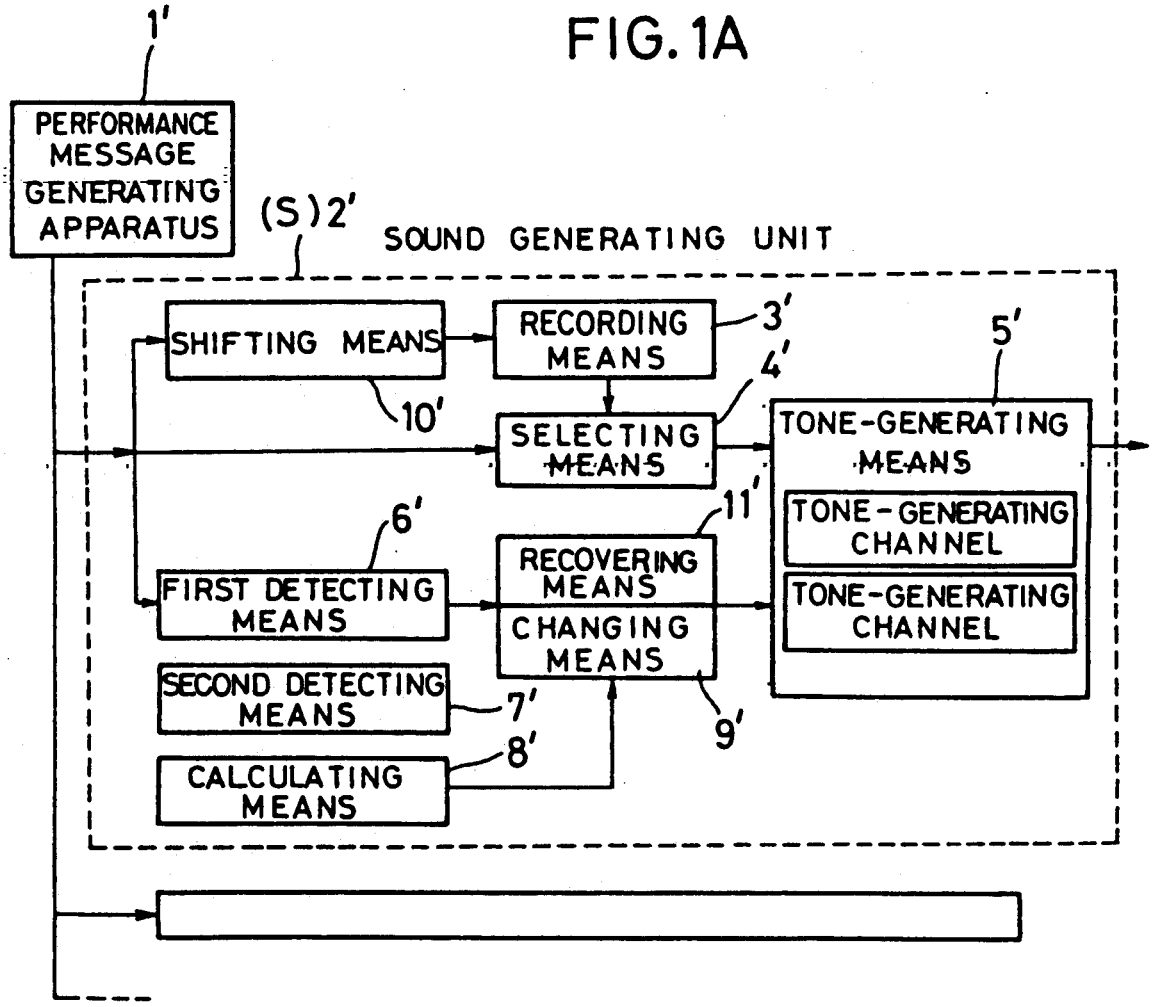

The variety in tone quality or timbre of the continuing portion of the musical tone generated, is enriched. In constituting the continuing portion with a plurality of second constituent tones B, for example, as shown in FIG. 1, this portion is composed of second constituent tones B1 and B2. In the second constituent tone B1, higher harmonic components of the continuing portion corresponding to a heavy strike are strong and the envelope is relatively short In the other second constituent tone B2, higher harmonic components of the continuing portion corresponding to a light strike are weak and the envelope is relatively long, as will be explained below.

In this Modified Example 1, the musical tone-generating circuit 28 is composed of forty-eight musical tone-generating channels from a first channel to a forty-eighth channel. The first channel to the third channel, the fourth channel to the sixth channel, . . . , the forty-sixth channel to the forty-eighth channel form combinations (trios) generating desired musical tones, respectively. The second constituent tone B2 is assigned to the first channel, the fourth channel, . . . , the second constituent tone B2 is assigned to the second channel, the fifth channel, . . . , and the first constituent tone A is assigned to the third channel, the sixth channel, .... , to produce musical tone-signals, respectively. Consecutive strikes of one key are detected by searching a musical tone-generating channel which is actually generating the second constituent tone B2 caused by the same key. The envelopes are changed based on the sum of generated volumes of the second constituent tones B1 and B2. Further, "3" instead of "2" is added to the number of loops "i" in the consecutive-strike detecting routine at Step O-3. There is basically no further difference between this Example and the second embodiment.

MODIFIED EXAMPLE 2

Here is described another modified example in which each tone-generating channel produces an integral musical tone that is not divided into such first and second constituent tones A and B as in the second embodiment.

Thus, musical tones generated here have, as illustrated in FIG. 19, a composite waveform that is integrated from a waveform of the first constituent tone A and a waveform of the second constituent tone B.

A difference from the second embodiment is that "1" is added to the number of loops "i" in place of adding "2" thereto in Step O-3 of the consecutive-strike detecting routine.

Also, another difference is that in Step Q-8 of the consecutive-strike processing routine, the generated volume WOL of of the second constituent tone B to be generated by the old key-press is calculated by adding the envelope level of the first constituent tone A to an evaluated multiple of the envelope level of the second constituent tone B. Said envelope level of the tone A is obtained from the envelope level LEV of a musical tone composite tone) that is to be generated here, by making use of a conversion table or the like that corresponds to the envelope waveform graph given in FIG. 19. Said evaluated multiple is obtained by multiplying the residual factor KD by the further envelope level of the second constituent B, the further envelope level in turn being also obtained from said envelope level LEV by using the conversion table in the same manner as just described above.

As a simple processing, the generated volume WOL of the second constituent tone B to be generated by the old key-press may be replaced by the envelope level LEV of the musical tone (composite tone) generated.

MODIFIED EXAMPLE 3

In still another modified example wherein, to obtain the variety in tone quality of the continuing portion and to reduce the number of constituent tones, the tone of the initial portion and the tone of the continuing portion are contained at different ratios in the first and the second constituent tones A and B, instead of composing a musical tone with said first and second tones per se.

Figure 23:
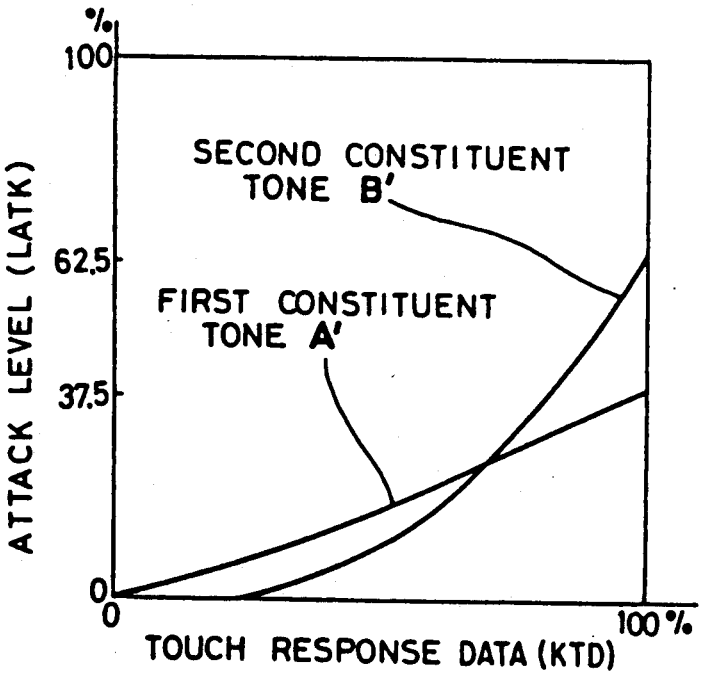
Figure 22:
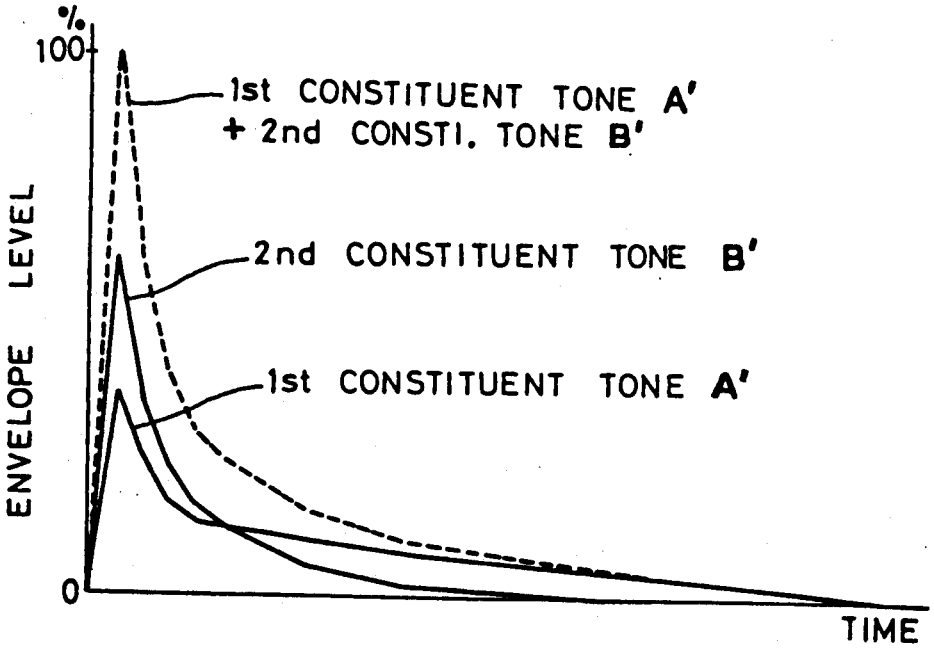

A musical tone generated as shown in FIG. 22 consists of first and second constituent tones A' and B'. The first constituent tone A' which is not varied excessively in tone quality by the strength of touch and constitutes mainly the initial portion of a light key-depression, contains a small quantity of higher harmonic components and gives a round feeling. The second constituent tone B' is large at a heavy touch and constitutes mainly the continuing portion of a heavy key-depression which, in the case of a piano, contains a large quantity of higher harmonic components and gives a hard feeling. FIG. 23 shows a touch response data KTD-attack level LATK giving a relationship between the touch response data KTD and the attack level LATK, which relationship is equivalent to that given in FIG. 12. Accordingly, the constituent tone B' is not generated at a light key-depression, and the first constituent tone A' dominates the musical tone.

In addition, the difference from the second embodiment is that in Step Q-8 of the consecutive strike processing routine the generated volume WOL to be generated by the old key-press is obtained by adding such a generated volume of the first constituent tone A' to such a generated volume of the tone B' as respectively described in the Modified Example 2.

In the Modified Examples 2 and 3 of the second embodiment, the ratio of one constituent tone to the other constituent tone is variable so that the resulting musical tone also may be varied.

In the second embodiment, the sounds of decaying or percussive types may include of course those sounds such as drumbeats, which are generated by consecutively striking one and the same tone-generating means (e.g., membrane or other struck surface), in addition to those generated by the keyboard apparatus.

The present invention is applicable to processing in the case wherein musical tones are generated by the manually operable members, for instance the so-called key switch or the like so as to be superposed one on another, in such a manner as in an electronic drum machine system, a rhythm machine system or the like. In that case, it is also possible to enhance the performability, for example by conducting quick consecutive strikes or beats, if the same musical tone is assigned to two or more manually operable members so that said same musical tone is generated corresponding to the alternatively repeated operations of said members.

Furthermore, the present invention is applicable also to a performing apparatus system such as a rhythm machine system or an automatic performing or accompanying apparatus system which can store or program a performance, automatically perform or automatically accompany wherein the same musical note is repeated in a superposed manner, if the key-press/off informations generated by key-press/off operations in the embodiments are converted into such key-press/off informations or equivalents as generated in the performing apparatus just described above, or are changed into other informations corresponding to processings peculiar to the performing apparatus just described above.

Although the audio system (i.e., the amplifier 13 and the loud-speaker 14) was described as a single system adapted to integrally output the inputs from the combined sound generating units S and S', there may be employed a plurality of audio systems that comprising loud-speakers spaced apart from each other whereby sounds are emitted flip-floppingly from sound sources positioned at different locations at each time the key is depressed, thus giving a peculiar auditory effect In this case, the data of preferential orders may be divided into groups separately supplied to each incorporated signal-receiving channels, i.e., timbres.

The performance message generating apparatus may be selected from the keyboard apparatus (the so-called mother keyboard) lacking sound generating units, the manually operable members actually operated by a user to generate performance messages in the electronic drum apparatus or rhythm machine, and the sequencer or the likes which automatically generate performance messages for the automatic performing or accompanying apparatuses.

There may be incorporated a sound generating unit that has its own keyboard part integral therewith though the sound generating units exemplified in the embodiments do not have such an keyboard part integral therewith. In this case, the performance messages produced in the keyboard part may be transmitted to an outside sound generating unit in order to generate sounds besides those generated by the internal sound generating units so that the total number of sound sources are increased.

All of the registers used in each embodiment are installed in areas assigned imaginally to the RAM 22C of the microcomputer 22 as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A system of electronic musical sound generating units for an electronic musical instrument system that comprises at least one device for generating performance controlling messages, said sound generating units each being responsive to performance controlling messages received from the performance message generating device, and each of said sound generating units comprising recording means for recording preferential orders that determine a sequential order by which each sound generating unit receives performance controlling messages;

selecting means for selecting performance controlling messages to be received by said sound generating unit in accordance with preferential orders recorded by the recording means; and tone-generating means for generating musical tones based on performance controlling messages that have been selected by the selecting means.

2. An electronic musical system as defined in claim 1, further comprising shifting means adapted to shift, in a circulative sequence, the preferential orders based on initial values thereof and on initial data representative of the number of sound generating units in said system wherein the preferential orders are recorded for each of said sound generating units based on received performance controlling messages.

3. An electronic musical system as defined in claim 2 wherein the shifting means is adapted to shift the preferential orders recorded by the recording means each time a note-on message is received by one of said sound generating units.

4. An electronic musical system as defined in claim 1 wherein the performance message generating device is selected from a mother keyboard and a sequencer.

5. An electronic musical system as defined in claim 1 and applied to any of the group of electronic musical instruments consisting of an electronic musical instrument having a keyboard, an electronic drum apparatus, a rhythm machine, an automatic performing apparatus and an automatic accompanying apparatus.

6. A system of electronic musical sound generating units for an electronic musical instrument system that comprises at least one device for generating performance controlling messages that include note-on messages, said sound generating units each being responsive to performance controlling messages received from the performance message generating device, and each of the sound generating units comprising recording means for recording preferential orders that determine a sequential order by which each sound generating unit receives performance controlling messages;

selecting means for selecting performance controlling messages to be received by the sound generating unit in accordance with preferential orders stored in the recording means;

tone-generating means having musical tone-generating channels that generate musical tones in response to note-on messages of performance controlling messages that have been selected by the selecting means;

first detecting means for detecting whether or not a second musical tone generated in response to a new note-on message and a first musical tone which has been generated in response to a previous note-on message tone;

second detecting means for detecting the volume of the first musical tone;

calculating means for calculating a residual tone volume based on the volume which is detected by the second detecting means; and changing means, responsive to a detection by the first detecting means that the second musical tone is the same as the first musical tone, for changing the volume of the first musical tone to the residual volume calculated by the calculating means.

7. An electronic musical system as defined in claim 6 wherein the second detecting means is adapted to detect musical tone volume based on a constituent tone which mainly provides a continuing portion of the first musical tone.

8. An electronic musical system as defined in claim 6 wherein the calculating means is adapted to calculate the residual tone volume WEL based on the an equation:

$$WEL = WOL \times KD$$

where WOL is volume of the musical tone generated in response to the previous note-on message, and KD is a residual factor providing the residual volume which is decreased by the second musical tone generated in response to the new note-on message.

9. An electronic musical system as defined in claim 6 wherein the changing means is adapted to change an envelope of the first musical tone so as to change the volume of the first musical tone to the residual volume.

10. An electronic musical system as defined in claim 6 wherein the second detecting means is adapted to simulate an envelope waveform of the second musical tone to thereby detect the volume thereof.

11. An electronic musical system as defined in claim 6 wherein the second detecting means is adapted to detect the generated volume of the first musical tone based on an envelope level thereof.

12. An electronic musical system as defined in claim 8 wherein the residual factor corresponds to an intensity of the first musical tone, an interval between generation of the first musical tone and generation of the second musical tone, pitches of the first and second musical tones, timbres of the first and second musical tones, and high harmonic components included in the first and second musical tones.

13. An electronic musical system as defined in claim 8 wherein the residual factor has a random value added thereto.

14. An electronic musical system as defined in claim 6 further comprising recovering means adapted to recover a note-on state from a note-off state for a musical tone assigned to one of the tone-generating channels in the corresponding tone-generating means of one of the sound generating units when the first detecting means detects that a second musical tone generated in response to a new note-on message is the same as a first musical tone generated in response to a previous note-on message by said one tone generating channel.

15. An electronic musical system as defined in claim 14 wherein the recovering means is adapted to reset the envelope waveform of said one tone-generating channel to an envelope waveform corresponding to a musical tone in the note-on state from an envelope waveform corresponding to a musical tone in the note-off state.

16. An electronic musical system as defined in claim 6, further comprising shifting means adapted to shift, in a circulative sequence, the preferential orders based on initial values thereof and on initial data representative of the number of sound generating units in said system wherein the preferential orders are recorded for each of the sound generating units based on the performance controlling messages.

17. An electronic musical system as defined in claim 16 wherein the shifting means is adapted to shift the preferential orders recorded by the recording means each time a note-on message is received by one of said sound generating units.

18. An electronic musical system as defined in claim 6 wherein the performance message generating device is selected from a mother keyboard and a sequencer.

19. An electronic musical system as defined in claim 6 and applied to any of the group of electronic musical instruments consisting of an electronic musical instrument having a keyboard, an electronic drum apparatus, a rhythm machine, an automatic performing apparatus and an automatic accompanying apparatus.

* * * * *